US010805725B2

(12) United States Patent
Rivera Benois et al.

(10) Patent No.: US 10,805,725 B2
(45) Date of Patent: Oct. 13, 2020

(54) ACTIVE NOISE CANCELLATION SYSTEM

(71) Applicant: Helmut-Schmidt-Universitaet Universitaet der Bundeswehr Hamburg, Hamburg (DE)

(72) Inventors: Piero Rivera Benois, Hamburg (DE); Udo Zoelzer, Neu Wulmstorf (DE)

(73) Assignee: Helmut-Schmidt-Universitaet Universitaet der Bundeswehr Hamburg, Hamburg (DE)

( * ) Notice: Subject to any disclaimer, the term of this patent is extended or adjusted under 35 U.S.C. 154(b) by 0 days.

(21) Appl. No.: 16/451,259

(22) Filed: Jun. 25, 2019

(65) Prior Publication Data

US 2020/0007984 A1 Jan. 2, 2020

(30) Foreign Application Priority Data

Jun. 29, 2018 (EP) ..... 18180974

(51) Int. Cl.
*H04R 3/04* (2006.01)
*G10L 21/0232* (2013.01)
(Continued)

(52) U.S. Cl.
CPC ..... *H04R 3/04* (2013.01); *G10L 21/0232* (2013.01); *H04R 5/033* (2013.01); *H04R 5/04* (2013.01);
(Continued)

(58) Field of Classification Search
CPC . H04R 3/04; H04R 5/033; H04R 5/04; H04R 2460/01; H04R 1/1083;
(Continued)

(56) References Cited

U.S. PATENT DOCUMENTS 7,295,397 B1 * 11/2007 Chang ..... G11B 5/5526 360/78.09
10,034,092 B1 * 7/2018 Nawfal ..... H04R 5/027
(Continued)

FOREIGN PATENT DOCUMENTS

WO 9707497 A1 2/1997

OTHER PUBLICATIONS

Schumacher, Thomas et al.: "Active NOICE Control in Headsets: A New Approach for Broadband Feedback ANC" Institute of Communication Systems and Data Processing, RWTH Aachen University, Germany ICASSP 2011, pp. 417-420.
(Continued)

*Primary Examiner* — Ahmad F. Matar
*Assistant Examiner* — Sabrina Diaz
(74) *Attorney, Agent, or Firm* — Stephen A. Pendorf; Patent Central LLC

(57) ABSTRACT

An active noise cancellation system for reducing unwanted noise in a target area by attenuating a disturbance noise signal (d(n)), which is the remaining noise in the target area originated from an ambient noise signal (x(n)) present in the vicinity of the target area that is transferred to the target area via a main path described by a transfer function P(z)), the active noise cancellation system including a processing unit that implements an ANC-controller which is configured to provide a control signal (y'(n)) for controlling a speaker in the target area in order to generate an acoustic signal (y(n)) that destructively overlaps with the disturbance noise signal (d(n)) and thereby attenuates the same.

15 Claims, 10 Drawing Sheets

(51) Int. Cl.
*H04R 5/033* (2006.01)
*H04R 5/04* (2006.01)
*H04S 7/00* (2006.01)

(52) U.S. Cl.
CPC ..... *H04S 7/307* (2013.01); *H04R 2460/01* (2013.01); *H04S 2420/01* (2013.01)

(58) Field of Classification Search
CPC . G10L 21/0232; H04S 7/307; H04S 2420/01; G10K 11/1788; G10K 11/178; G10K 11/1784; G10K 2210/1081
USPC ..... 381/71.1–71.14
See application file for complete search history.

(56) References Cited

U.S. PATENT DOCUMENTS

| | | | | |
|---|---|---|---|---|
| 2010/0014685 | A1* | 1/2010 | Wurm | G10K 11/17881 381/71.11 |
| 2013/0301846 | A1* | 11/2013 | Alderson | H04R 3/00 381/71.7 |
| 2015/0243271 | A1 | 8/2015 | Goldstein | |
| 2016/0240184 | A1* | 8/2016 | Raja | G10K 11/17817 |
| 2017/0053639 | A1* | 2/2017 | Lu | G10K 11/178 |
| 2017/0125006 | A1* | 5/2017 | Dzhigan | G10K 11/17881 |

OTHER PUBLICATIONS

Kuo, Sen M. et al.: "Active Noise Control: A Tutorial Review" Proceedings of the IEEE, vol. 87, No. 6, Jin. 1999, pp. 943-973.
Morgan, Dennis R. et al.: "A Multitone Pseudocascade Filtered-X LMS Adaptive Notch Filter" IEEE Transaction of Signal Processing, vol. 41, No. 2, Feb. 1993, pp. 946-956, New York, US.

* cited by examiner

ACTIVE NOISE CANCELLATION SYSTEM

BACKGROUND OF THE INVENTION

Field of the Invention

The invention relates to an active noise cancellation system for reducing unwanted noise in a target area and a method for actively cancelling unwanted noise in a target area.

Description of the Related Art

Active Noise Cancelling (ANC) systems when integrated in user equipment like headphones provide to the user with an attenuation of the acoustical noise present in the environment. In case of headphones, this protection is a mixed effect of the characteristics of the headphone's construction materials and the ANC method applied to the noise that effectively enters the ear-cups. The passive attenuation produced by the materials is effective in the mid and high frequency ranges. The low frequency range is actively treated by ANC, by generating sound pressure through the headphone's speaker, such that the environmental noise is cancelled out by superposition.

Generally, ANC headphones are equipped as indicated in FIG. 1. A reference microphone outside the ear-cup measures the incident noise x(n). This noise signal travels through the ear-cup and reaches the position of the error microphone as d(n). Thus, the transfer function P(z) represents the influence of the headphone's materials and the relative position of the noise source to the system. The control signal y'(n) is played back through the headphone's speaker and transformed into y(n) by the transfer function S(z), also known as the secondary path. This transfer function S(z) represents the influences of the speaker, the error microphone, and the acoustic path between them. Finally, the acoustic signals y(n) and d(n) overlap destructively and lead to the residual error e(n) at the position of the error microphone.

ANC solutions that use x(n) for generating y'(n) are called feedforward approaches, while the ones that use e(n) instead are denoted feedback approaches. Feedforward solutions based on adaptive filter techniques make also use of e(n) as input for the adaptation algorithm, as for instance known from reference [1]. Adaptive feedback solutions make use of e(n) only.

Feedback solutions are preferred over the feedforward (FF) ones, because their implementations rely on the usage of only one microphone per ear-cup. Moreover, they are less prone to performance degradation under changing directionality conditions, due to the smaller distance between microphone and the entrance of the ear canal.

A solution commonly found in commercial ANC headphones is a feedback control scheme called Minimum Variance Control (MVC), as for instance known from reference [2]. The controller is designed to minimize the variance of e(n) under the excitation of a stochastic signal d(n), as for instance described in reference [3]. Although this scheme is very effective against low frequency stochastic signals, its bandwidth and attenuation levels are limited by the delays in the control chain and by the control loop stability constraints, as for instance described in reference [4].

In order to partially overcome the attenuation bandwidth limitation of the MVC, a control scheme called Internal Model Control (IMC) combined with an adaptation algorithm can be used, as for instance known from reference [2] together with reference [5]. This combination offers the opportunity to attenuate the low frequency stochastic components that are not passively attenuated by the headphone materials, and any tonal components present in the environmental noise.

In order to partially overcome the limitations of the control structure and to improve the system's performance, one can combine it with another control scheme into a hybrid structure. This can either be an IMC-MVC combination, which yields a hybrid structure with independent IMC optima, as for instance known from reference [6] together with reference [7], or with independent IMC optima, as for instance known from reference [8] together with reference [9], reference [10] and reference [11]; an IMC-FF combination with independent FF optima, as for instance known from reference [12] together with reference [13], reference [14] and reference [15] or dependent FF optima, as for instance known from reference [16] together with reference [17], reference [18], reference [19] and reference [20]; or an MVC-FF combination with independent FF-optima, as for instance known from reference [21] together with reference [22], reference [23] and reference [24] or dependent FF optima as for instance known from reference [25] and reference [26].

The problem with dependent optima arises when improvements in one controller are desired after the other one has already been calculated. Thus, this would drift one of the controllers from its optimum and a recalculation of it would be required. For controllers that are derived with Wiener Filter Theory, as for instance described in reference [5], this means to perform measurements under certain laboratory conditions and repeat resource-expensive calculations. For adaptive controllers based on adaptive Least Mean Squared filters (FxLMS-filters), the changes would introduce deviations in the estimated gradient, which may either produce a non-optimum solution or run the system into instability. The hybrid structure originally proposed by Schumacher et al. in reference [6] for the IMC-MVC combination is the only one that overcomes both issues, i.e. optimum dependency and altered gradient. Nevertheless, complications are still found in the parameterization of adaptation algorithms to yield satisfying attenuation levels under unsupervised manipulation and excitation circumstances.

It is therefore an objective of the present invention to provide an active noise cancellation system comprising an ANC-controller implementing a control structure which produces an efficient system transfer function for attenuating noise in a target area and which provides a beneficial alternative to existing solutions.

BRIEF SUMMARY OF THE INVENTION

The invention comprises an active noise cancellation system for reducing unwanted noise in a target area by attenuating a disturbance noise signal (d(n)), which is the remaining noise in the target area originated from an ambient noise signal (x(n)) present in the vicinity of the target area that is transferred to the target area via a main path described by a transfer function (P(z)), the active noise cancellation system comprising a processing unit that implements an ANC-controller which is configured to provide a control signal (y'(n)) for controlling a speaker in the target area in order to generate an acoustic signal (y(n)) that destructively overlaps with the disturbance noise signal (d(n)) and thereby attenuates the same, wherein the control signal (y'(n)) is transferred into the acoustic signal (y(n)) via the secondary path described by the transfer function (S(z)), and wherein the ANC-controller provides a system transfer function (H(z)), which minimizes a residual error signal (e(n)), wherein the residual error signal (e(n)) represents the difference between the acoustic signal (y(n)) and the disturbance noise signal (d(n)) after a destructive overlap of the same, and wherein the ANC-controller comprises a control structure which consist of an Internal Model Control (IMC) feedback control structure (IMC control structure) comprising an IMC-controller ($W_{imc}(z)$) and a secondary path estimate filter described by the transfer function ($\hat{S}(z)$), a Minimum Variance Control (MVC) feedback control structure (MVC control structure) comprising a MVC-controller ($W_{mvc}(z)$) and a feedforward (FF) control structure (FF control structure) comprising a FF-controller ($W_{ff}(z)$), and wherein the IMC control structure, the MVC control structure and the FF control structure are interconnected and combined to form a common multi-hybrid control system.

In this embodiment the ambient noise signal (x(n)) is preferably captured via a transducer like a reference microphone located in the vicinity of the target area and it is fed as an input signal into the ANC-controller. The ANC-controller may also be fed with the residual error signal (e(n)) which is preferably captured via a transducer like an error microphone located in the target area. The ANC-controller then processes these input signals via the multi-hybrid control system formed by the IMC control structure, the MVC control structure and the FF control structure and provides the control signal (y'(n)) as an output signal for controlling a speaker in the target area.

In case the inventive control system is applied on noise cancelling headphones, the target area is located in the space under the ear cups before the ear channel of the headphones' user. The main path (P(z)) accounts for various influencing factors in the path of the noise from the vicinity of the target area into the target area like for example physical barriers, temperature and humidity. In case of active noise cancelling headphones, the main path (P(z)) accounts for the influence of the headphone's materials and the relative position of a noise source to the system. In accordance with the invention, the ANC-controller may only comprise one IMC-controller, one MVC-controller and one FF-controller which are combined into one common controller element. However, the ANC-controller may also comprise one or more than one of each controller type. Therefore, one or more than one IMC-controller may be combined and interconnected with one or more than one MVC-controller and one or more than one FF-controller. Details and specific implementations of the controller types IMC-controllers, MVC-controllers and FF-controllers may be as shown in references [1] through [26] which are for that reason expressly referred to.

Although clear for the person skilled in the art, it shall be understood, that signals denoted with "(n)" are discrete-time signals and signals denoted with "(z)" are their z-transformed counterparts.

In a first embodiment of the invention the ANC-controller is configured such that the ambient noise signal (x(n)) is filtered by the FF-controller ($W_{ff}(z)$) providing a feedforward control signal ($y_f(n)$) which is then combined with a feedback control signal ($y_m(n)$) provided by the MVC-controller ($W_m(z)$) and a feedback control signal ($y_i(n)$) provided by the IMC-controller ($W_{imc}(z)$), wherein the resulting control signal (y'(n)) is transferred by the secondary path (S(z)) in order to provide the acoustic signal (y(n)) which destructively overlaps with the disturbance noise signal (d(n)). The ambient noise signal (x(n)) is preferably provided as an input signal to the ANC-controller. The control signal (y'(n)) is preferably provided as an output signal from the ANC-controller.

In a further embodiment of the invention the ANC-controller is configured such that the residual error signal (e(n)) is combined with an output signal ($\hat{y}_1(n)$) provided by the secondary path estimate filter ($\hat{S}(z)$), the resulting signal ($\hat{d}_{fm}(n)$) is then fed into the IMC-controller ($W_{imc}(z)$) and it is further fed into the MVC-controller ($W_{mvc}(z)$), and wherein an output signal ($y_i(n)$) provided by the IMC-controller ($W_{imc}(z)$) is fed into the secondary path estimate filter ($\hat{S}(z)$) and the output signal ($y_i(n)$) is further combined with a signal ($y_{fm}(n)$) resulting from a combination of the output ($y_f(n)$) of the FF-controller ($W_{ff}(z)$) and the output signal ($y_m(n)$) provided by the MVC-controller ($W_{mvc}(z)$), in order to provide the control signal (y'(n)). The residual error signal (e(n)) is preferably provided as an input signal to the ANC-controller.

According to another embodiment the ANC-controller is configured such that the residual error signal (e(n)) is combined with an output signal ($\hat{y}_i(n)$) provided by a first secondary path estimate filter ($\hat{S}(z)$), the resulting signal ($\hat{d}_{fm}(n)$) is fed into the IMC-controller ($W_{imc}(z)$) and the resulting signal ($\hat{d}_{fm}(n)$) is further combined with an output signal ($\hat{y}_f(n)$) provided by a second secondary path estimate filter ($\hat{S}(z)$), the resulting combined signal ($\hat{d}_m(n)$) is fed into the MVC-controller ($W_{mvc}(z)$), and wherein an output signal ($y_i(n)$) provided by the IMC-controller ($W_{imc}(z)$) is fed into the first secondary path estimate filter ($\hat{S}(z)$) and the output signal ($y_i(n)$) is further combined with a signal ($y_{fm}(n)$) resulting from a combination of the output signal ($y_f(n)$) of the FF-controller ($W_{ff}(z)$) and the output signal ($y_m(n)$) provided by the MVC-controller ($W_{mvc}(z)$) in order to provide the control signal (y'(n)), and wherein the output signal ($y_f(n)$) is fed into the second secondary path estimate filter ($\hat{S}(z)$).

In a further embodiment the ANC-controller is configured such that the residual error signal (e(n)) is combined with an output signal ($\hat{y}_{fi}(n)$) provided by a secondary path estimate filter ($\hat{S}(z)$), the resulting signal ($\hat{d}_m(n)$) is fed into the IMC-controller ($W_{imc}(z)$) and it is further fed into the MVC-controller ($W_{mvc}(z)$), and wherein an output signal ($y_i(n)$) provided by the IMC-controller ($W_{imc}(z)$) is combined with an output signal ($y_f(n)$) provided by the FF-controller ($W_{ff}(z)$), the resulting combined signal ($y_{fi}(n)$) is then fed into the secondary path estimate filter ($\hat{S}(z)$) and the resulting combined signal ($y_{fi}(n)$) is further combined with an output signal ($y_m(n)$) provided by the MVC-controller ($W_{mvc}(z)$), in order to provide the control signal (y'(n)).

In a system design with independent FF-controller's optimum, the IMC control structure, the MVC control structure and the FF control structure are interconnected such that if the equality $\hat{S}(z)=S(z)$ holds, then the system transfer function (H(z)), which in this embodiment is the analytic relationship derived from the system's components between the residual error signal (e(n)) in Z-Transform domain (E(z)) and the ambient noise signal (x(n)) in Z-Transform domain (X(z)), corresponds to a multiplicative combination of the transfer function of the IMC control structure, the transfer function of the MVC control structure and the transfer function of the FF control structure, wherein preferably the system transfer function (H(z)) corresponds to:

$$\frac{E(z)}{X(z)} = \frac{(P(z) - S(z)W_{ff}(z))(1 - S(z)W_{imc}(z))}{1 + S(z)W_{mvc}(z)}.$$

In accordance with this embodiment, the transfer function of the IMC control structure may correspond to the multiplicative factor:

$$(1 - S(z)W_{imc}(z)).$$

The transfer function of the MVC control structure may correspond to the multiplicative factor:

$$\frac{1}{1 + S(z)W_{mvc}(z)}.$$

The transfer function of the FF control structure may correspond to the multiplicative factor:

$$(P(z) - S(z)W_{ff}(z))$$

In a system design with partially independent FF-controller's optimum, the IMC control structure, the MVC control structure and the FF control structure are interconnected such that if the equality $\hat{S}(z)=S(z)$ holds, then the system transfer function (H(z)), which in this embodiment is the analytic relationship derived from the system's components between the residual error signal (e(n)) in Z-Transform domain (E(z)) and the ambient noise signal (x(n)) in Z-Transform domain (X(z)), corresponds to a multiplicative combination of the transfer function of the IMC control structure and the transfer function of a hybrid sub-structure of the ANC-controller comprising the transfer function of the MVC control structure and the FF controller, wherein preferably the system transfer function (H(z)) corresponds to:

$$\frac{E(z)}{X(z)} = (1 - S(z)W_{imc}(z))\left(\frac{P(z)}{1 + S(z)W_{mvc}(z)} - S(z)W_{ff}(z)\right).$$

In accordance with this embodiment, the transfer function of the IMC control structure may correspond to the multiplicative factor:

$$(1 - \hat{S}(z)W_{imc}(z)).$$

The transfer function of the hybrid sub-structure may correspond to the multiplicative factor:

$$\left(\frac{P(z)}{1 + S(z)W_{mvc}(z)} - S(z)W_{ff}(z)\right).$$

In this transfer function of the hybrid sub-structure the transfer function of the MVC control structure may correspond to:

$$\frac{1}{1 + S(z)W_{mvc}(z)}.$$

In a system design with dependent FF-controller's optimum, the IMC control structure, the MVC control structure and the FF control structure are interconnected such that if the equality $\hat{S}(z)=S(z)$ holds, then the system transfer function (H(z)), which in this embodiment is the analytic relationship derived from the system's components between the residual error signal (e(n)) in Z-Transform domain (E(z)) and the ambient noise signal (x(n)) in Z-Transform domain (X(z)), comprises the transfer function of the FF-control structure and a multiplicatve combination of the transfer function of the IMC control structure and the transfer function of the MVC control structure, wherein preferably the system transfer function (H(z)) corresponds to:

$$\frac{E(z)}{X(z)} = \frac{P(z)(1 - S(z)W_{imc}(z))}{1 + S(z)W_{mvc}(z)} - S(z)W_{ff}(z).$$

In accordance with this embodiment, the transfer function of the IMC control structure may correspond to the multiplicative factor:

$$(1 - \hat{S}(z)W_{imc}(z)).$$

The transfer function of the MVC control structure may correspond to the multiplicative factor:

$$\frac{1}{1 + S(z)W_{mvc}(z)}.$$

The invention further comprises an active noise cancellation system for reducing unwanted noise in a target area by attenuating a disturbance noise signal (d(n)), which is the remaining noise in the target area originated from an ambient noise signal (x(n)) present in the vicinity of the target area that is transferred to the target area via a main path described by a transfer function (P(z)), the active noise cancellation system comprising a processing unit that implements an ANC-controller which is configured to provide a control signal (y'(n)) for controlling a speaker in the target area in order to generate an acoustic signal (y(n)) that destructively overlaps with the disturbance noise signal (d(n)) and thereby attenuates the same, wherein the control signal (y'(n)) is transferred into the acoustic signal (y(n)) via a secondary path described by a transfer function (S(z)), and wherein the ANC-controller provides a system transfer function (H(z)), which minimizes a residual error signal (e(n)), wherein the residual error signal (e(n)) represents the difference between the acoustic signal (y(n)) and the disturbance noise signal (d(n)) after a destructive overlap of the same, and wherein the ANC-controller comprises a control structure which consist of at least two Internal Model Control (IMC) feedback control structure (IMC control structure), each comprising an IMC-controller ($W_{imc}(z)$) and a secondary path estimate filter described by a transfer function ($\hat{S}(z)$), and wherein the IMC control structures are interconnected and combined to form a common multi-stage control system.

In an advantageous embodiment two individual IMC control structures, each comprising an IMC-controller ($W_1(z)$, $W_2(z)$), are interconnected such that if the equality $\hat{S}(z)=S(z)$ holds, then their associated system transfer function (H(z)), which in this embodiment is the analytic relationship derived from the system's components between the residual error signal (e(n)) in Z-Transform domain (E(z)) and the disturbance noise signal (d(n)) in Z-Transform domain (D(z)), corresponds to:

$$\frac{E(z)}{D(z)} = (1 - S(z)W_1(z))(1 - S(z)W_2(z)).$$

In accordance with the invention the ANC-controller may comprise more than two IMC-control structures. In such embodiment the multi-stage control system comprises n additional IMC control structures, each comprising an IMC-controller ($W_n(z)$), wherein the IMC control structures are interconnected and combined with each other such that each additional IMC control structure extends the system transfer function (H(z)) by the multiplicative term:

$$(1-\hat{S}(z)W_n(z)).$$

Experiments have shown, that a combination of three IMC-control structures can produce further improvements. In such implementation, three individual IMC control structures, each comprising an IMC-controller ($W_1(z)$, $W_2(z)$, $W_3(z)$), are interconnected such that their associated system transfer function (H(z)) corresponds to:

$$\frac{E(z)}{D(z)} = (1 - S(z)W_1(z))(1 - S(z)W_2(z))(1 - S(z)W_3(z)).$$

The invention further comprises an active noise cancellation system for reducing unwanted noise in a target area by attenuating a disturbance noise signal (d(n)), which is the remaining noise in the target area originated from an ambient noise signal (x(n)) present in the vicinity of the target area that is transferred to the target area via a main path described by a transfer function (P(z)), the active noise cancellation system comprising a processing unit that implements an ANC-controller which is configured to provide a control signal (y'(n)) for controlling a speaker in the target area in order to generate an acoustic signal (y(n)) that destructively overlaps with the disturbance noise signal (d(n)) and thereby attenuates the same, wherein the control signal (y'(n)) is transferred into the acoustic signal (y(n)) via a secondary path described by a transfer function (S(z)), and wherein the ANC-controller provides a system transfer function (H(z)), which minimizes a residual error signal (e(n)), wherein the residual error signal (e(n)) represents the difference between the acoustic signal (y(n)) and the disturbance noise signal (d(n)) after a destructive overlap of the same, and wherein the ANC-controller comprises a control structure which consist of at least two Minimum Variance Control (MVC) feedback control structures, each comprising a MVC-controller ($W_{mvc}(z)$) and a secondary path estimate filter described by a transfer function ($\hat{S}(z)$), and wherein the MVC control structures are interconnected and combined to form a common multi-stage control system.

In an advantageous embodiment two individual MVC control structures, each comprising an MVC-controller ($W_1(z)$, $W_2(z)$), are interconnected and combined such that if the equality $\hat{S}(z)=S(z)$ holds, then their associated system transfer function (H(z)), which in this embodiment is the analytic relationship derived from the system's components between the residual error signal (e(n)) in Z-Transform domain (E(z)) and the disturbance noise signal (d(n)) in Z-Transform domain (D(z)), corresponds to:

$$\frac{E(z)}{D(z)} = \frac{1}{(1 + S(z)W_1(z))(1 + S(z)W_2(z))}.$$

In accordance with the invention the ANC-controller may comprise more than two MVC-control structures. In such embodiment the multi-stage control system comprises n additional MVC feedback control structures, each comprising an MVC-controller ($W_n(z)$), wherein the MVC control structures are interconnected and combined with each other such that each additional MVC control structure extends the system transfer function (H(z)) by the multiplicative term:

$$\frac{1}{(1 + \hat{S}(z)W_n(z))}.$$

Experiments have shown, that a combination of three MVC-control structures are quite efficient in terms of cost to benefit ratio. In such implementation, three individual MVC control structures, each comprising a MVC-controller ($W_1(z)$, $W_2(z)$, $W_3(z)$), are interconnected and combined such that their associated system transfer function (H(z)) corresponds to $$\frac{E(z)}{D(z)} = \frac{1}{(1 + S(z)W_1(z))(1 + S(z)W_2(z))(1 + S(z)W_3(z))}.$$

The invention further comprises a method for actively cancelling unwanted noise in a target area utilizing an active noise cancelling system according to one of the above claims, comprising an ANC-controller which provides a system transfer function (H(z)) which minimizes a residual error signal (e(n)) representing the difference between an acoustic signal (y(n)) and a disturbance noise signal (d(n)) after a destructive overlap of the same, the method comprising the steps: generating the acoustic signal (y(n)) in the target area which overlaps with the disturbance noise signal (d(n)) present in the target area, receiving the residual error signal (e(n)) representing the difference between the acoustic signal (y(n)) and the disturbance noise signal (d(n)) after a destructive overlap of the same, and generating a control signal (y'(n)) for controlling the speaker such that the acoustic signal (y(n)) is shaped to minimize the residual error signal (e(n)).

Details and advantageous embodiments of the inventive method for actively cancelling unwanted noise in a target area can be found in and derived from the description above relating to the inventive control systems.

BRIEF DESCRIPTION OF THE SEVERAL VIEWS OF THE DRAWINGS

Details of the invention as described above and specific embodiments as well as advantageous implementations of the invention are set forth in the accompanying drawings and the description below. Features, objects, and advantages will be apparent from the description and drawings, and from the claims.

DETAILED DESCRIPTION OF THE INVENTION

Figure 1:
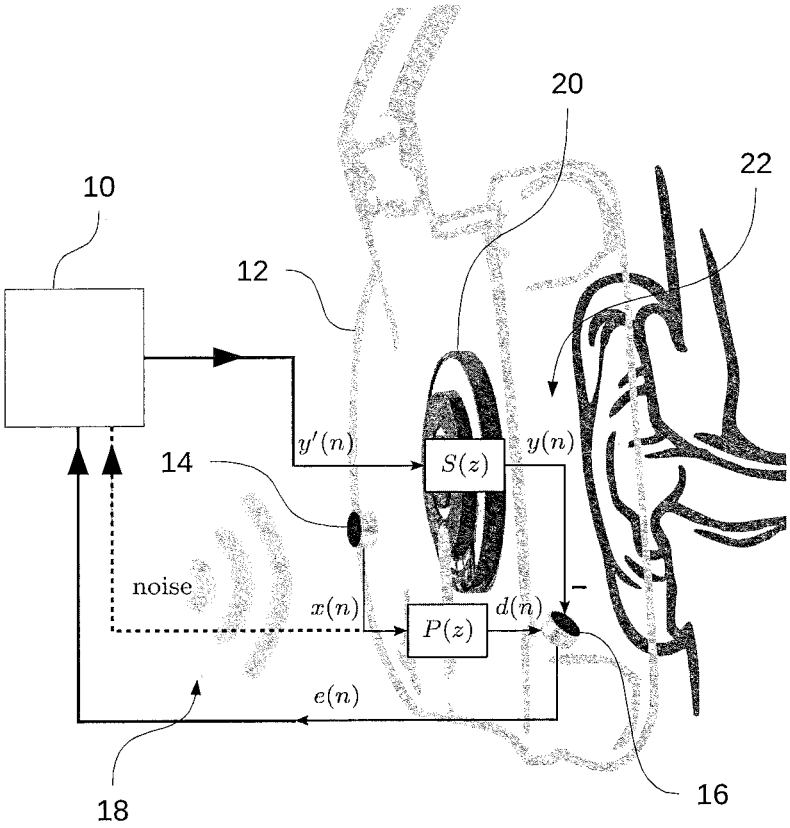
FIG. 1 is a general description of signals and systems related to an Active Noise Cancellation system for the application on headphones.

FIG. 1 shows the basic principle and first signals and systems for an active noise cancellation system applied for headphones, which may be an application of the invention. In a noise cancellation environment for headphones utilizing feedforward controller (FF-controller) a reference microphone 14 may be placed outside an ear-cup 12 measuring the incident noise x(n). This noise signal travels through the ear-cup and reaches the position of an error microphone 16 as d(n). The transfer function P(z) represents the influence of the headphone's materials and the relative position of a noise source 18 to the system. The control signal y'(n) is played back through a speaker 20 and transformed into y(n) by the transfer function S(z). This transfer function represents the influences of the speaker 20, the error microphone 16, and the acoustic path between them. Finally, the acoustic signals y(n) and d(n) overlap destructively and lead to the residual error e(n) at the position of the error microphone 16. Details of such system are also described in the introductory part of this application.

The ANC-controller 10 receives the residual error signal e(n), and in some embodiments of the invention preferably also the ambient noise signal x(n), and processes these via its control structure to provide the control signal y'(n). The ANC-controller 10 calculates the control signal y'(n) such that the overlap of the disturbance signal d(n) and the acoustic signal y(n) leads to a residual error signal e(n), which represents the remaining noise in the target area after a destructive overlap of y(n) and d(n). Thus, the control signal y'(n) is shaped by the ANC-controller 10 such that the unwanted noise in the target area 22 represented by the disturbance signal d(n) is cancelled out to a minimum.

For ANC-controllers with FF-controllers, the ANC-controller may receive the ambient noise signal x(n) as an input. For ANC-controllers without FF-controllers, it is not necessary to feed the ambient noise signal x(n) into the ANC-controller as an input signal.

Figure 2:
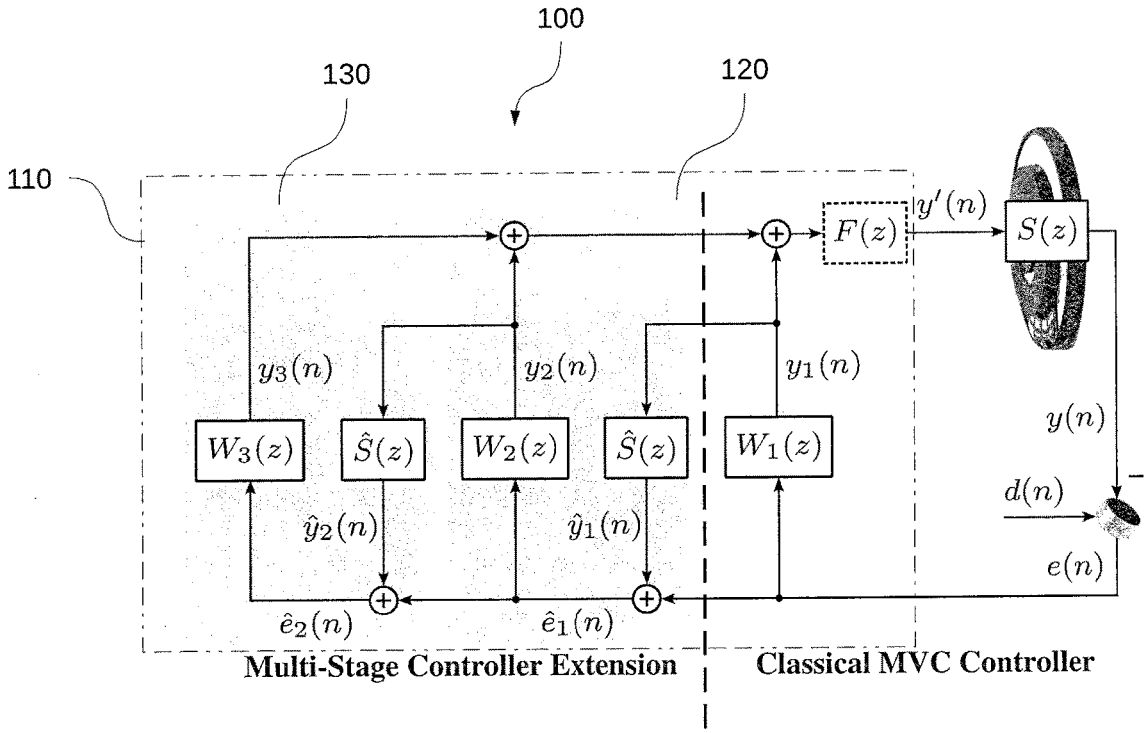
FIG. 2 is a multi-stage feedback controller design according to the invention example based on the classical MVC control scheme and two extension stages. Three different MVC-controllers $W_1(z)$, $W_2(z)$, and $W_3(z)$ are used and $\hat{S}(z)=F(z)S(z)$ is chosen.

FIGS. 2 through 7 show details for MVC control structures and in particular relate to the multi-stage system comprising two or more than two MVC control structures. The multi-stage controller according to the invention comprising two or more MVC control structures is based on the classical MVC structure as shown in the right side of FIG. 2, with the same signals and systems described in FIG. 1. FIG. 2 shows an ANC-system 100 comprising an ANC-controller 110. The ANC-controller 110 comprises a supplementary second stage 120 with an MVC control structure and a supplementary third stage 130 with an MVC control structure.

The MVC multi-stage system uses the error signal e(n) via a series connection of the control filter $W_1(z)$ in order to generate its control signal $y_1(n)$. The new filter F(z), called the channel equalizer, is introduced into the control chain in order to decrease and to shape an effect which is known in literature as the waterbed effect, and to improve the stability conditions of the overall system.

With a multi-stage strategy, further reduction of the error e(n) can be achieved by calculating the residual error $e_1(n)$ left by $W_3(z)$ and $W_2(z)$. This is done by first adding $\hat{y}_1(n)$ to the measured error e(n). For this purpose, a transfer function $\hat{S}(z)$ is introduced, known as estimated secondary path filter (secondary path estimate filter), wherein $\hat{S}(z)=S(z)F(z)$ is chosen, so that $\hat{y}_1(n)$ is equal to the phase-inverted control signal of $W_1(z)$ at the error microphone's 16 position. The residual error $e_1(n)$ is then used as input for $W_2(z)$. An approximation of the residual error $e_2(n)$ left only by $W_3(z)$ is subsequently calculated, based on the phase inverted control signal $\hat{y}_2(n)$. The signal $e_2(n)$ is then used as input for $W_3(z)$. Finally, the control signal of all stages $y_1(n)$, $y_2(n)$, and $y_3(n)$ are added together and filtered with F(z) for generating the control signal y'(n). Essentially, the input of every controller is an estimation of the remaining error left by the stages seen at its left-side in the diagram. If a different number of controllers is desired, the system's second stage structure 120 in FIG. 2 can be omitted or repetitions of it can be appended one next to the other.

The effect of such an incremental control loop as ANC system must be analyzed through its transfer function H(z). For this, the equations that define the system $$E(z)=D(z)-F(z)S(z)(Y_1(z)+Y_2(z)+Y_3(z)), \quad (1)$$

$$\hat{E}_1(z)=E(z)+\hat{Y}_1(z), \quad (2)$$

$$\hat{E}_2(z)=\hat{E}_1(z)+\hat{Y}_2(z), \quad (3)$$

$$Y_1(z)=W_1(z)\cdot E(z), \quad (4)$$

$$Y_2(z)=W_2(z)\cdot \hat{E}_1(z), \quad (5)$$

$$Y_3(z)=W_3(z)\cdot E_2(z), \quad (6)$$

$$\hat{Y}_1(z)=\hat{S}(z)\cdot Y_1(z), \text{ and} \quad (7)$$

$$\hat{Y}_2(z)=\hat{S}(z)\cdot Y_2(z) \quad (8)$$

are required. By using (4) to replace $Y_1(z)$ in (7), the resulting equation can be used to replace $\hat{Y}_1(z)$ in (2). The resulting definition of $\hat{E}_1(z)$ is then used in (5), so that $Y_2(z)$ can be reformulated as a function of E(z) given by $$Y_2(z)=W_2(z)\cdot(E(z)+\hat{S}(z)\cdot W_1(z)\cdot E(z)). \quad (9)$$

Similarly, using (2), (3), (4), (7), (8), and (9) in (6), $Y_3(z)$ can also be expressed as a function of E(z) given by $$Y_3(z)=W_3(z)(E(z)+\hat{S}(z)W_1(z)E(z)+\hat{S}(z)W_2(z)(E(z)+\hat{S}(z)W_1(z)E(z))) \quad (10)$$

Finally, if (4), (9), and (10) are respectively used to replace $Y_1(z)$, $Y_2(z)$, and $Y_3(z)$ in (1), and the condition $\hat{S}(z)=F(z)S(z)$ is met, then the transfer function of the overall system yields $$\frac{E(z)}{D(z)}=\frac{1}{(1+\hat{S}(z)W_1(z))(1+\hat{S}(z)W_2(z))(1+\hat{S}(z)W_3(z))} \quad (11)$$

As it can be seen, the resulting system transfer function H(z) comprehends a multiplicative combination of the ones of its individual sub-systems. No interdependency between controllers is to be found, which enables their independent design and/or optimization. Stability constraints can be then individually met, in order to yield a global one.

Figure 3:
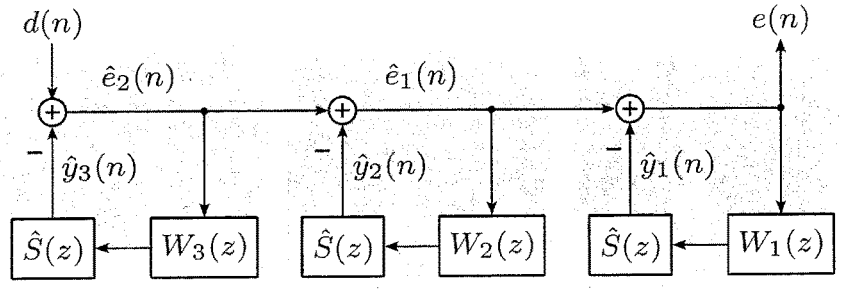
FIG. 3 is a multi-stage feedback controller's equivalent feedforward system in accordance with the invention. Three different MVC-controllers $W_1(z)$, $W_2(z)$, and $W_3(z)$ are used and $\hat{S}(z)=F(z)S(z)$ is chosen.

Based on the resulting overall transfer function H(z) in (11), the equivalent feedforward system of the multi-stage MVC structure is derived and presented in FIG. 3. In FIG. 3, the disturbance signal d(n) enters the first stage, where it is attenuated by the feedback control loop of $W_1(z)$. Subsequently, the following feedback loops of $W_2(z)$ and $W_3(z)$ attenuate the remaining error $\hat{e}_2(n)$ even further. The residual error e(n) is then the final remaining noise at the error microphone's position.

Figure 4:
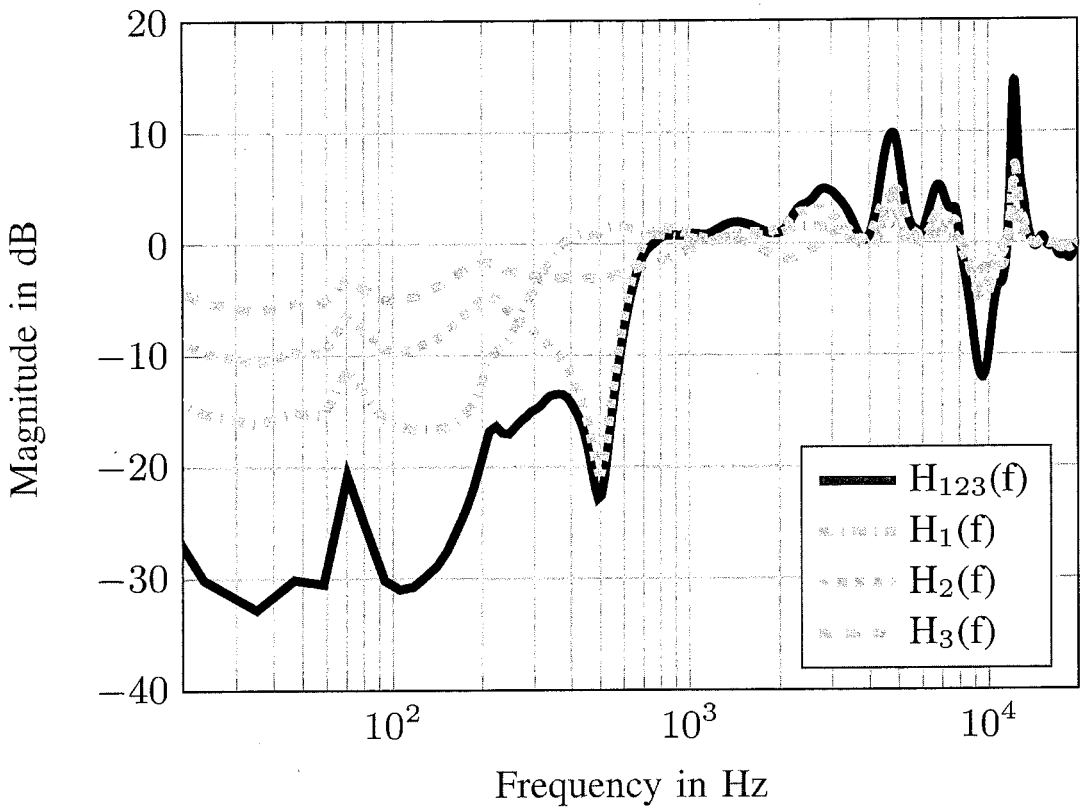
FIG. 4 is a multi-stage feedback controller example with three different MVC-controllers in accordance with the invention. $H_1(f)$, $H_2(f)$, and $H_3(f)$ are the frequency responses of the individual stages, and $H_{123}(f)$ the one of the resulting multi-stage controller.

The multi-stage feedback controller and channel equalizer provide new design possibilities for ANC systems based on MVC-controllers. FIG. 4 shows a first system implementation example with three different controllers aiming a broad attenuation band-width. The curves $H_1(f)$, $H_2(f)$, and $H_3(f)$ show the frequency responses generated by each controller separately, while $H_{123}(f)$ is the frequency response using the multi-stage approach. The first thing to notice is that the attenuation capabilities of the individual controllers positively combine in the lower frequency range to reach values of up to 30 dB and a bandwidth of 760 Hz. An expected but not desired effect is that not only the attenuation capabilities of the individual systems are combined, but also the amplifications produced by an effect known as the waterbed effect. Thus, strong peaks and notches appear in the high frequency range.

Figure 5:
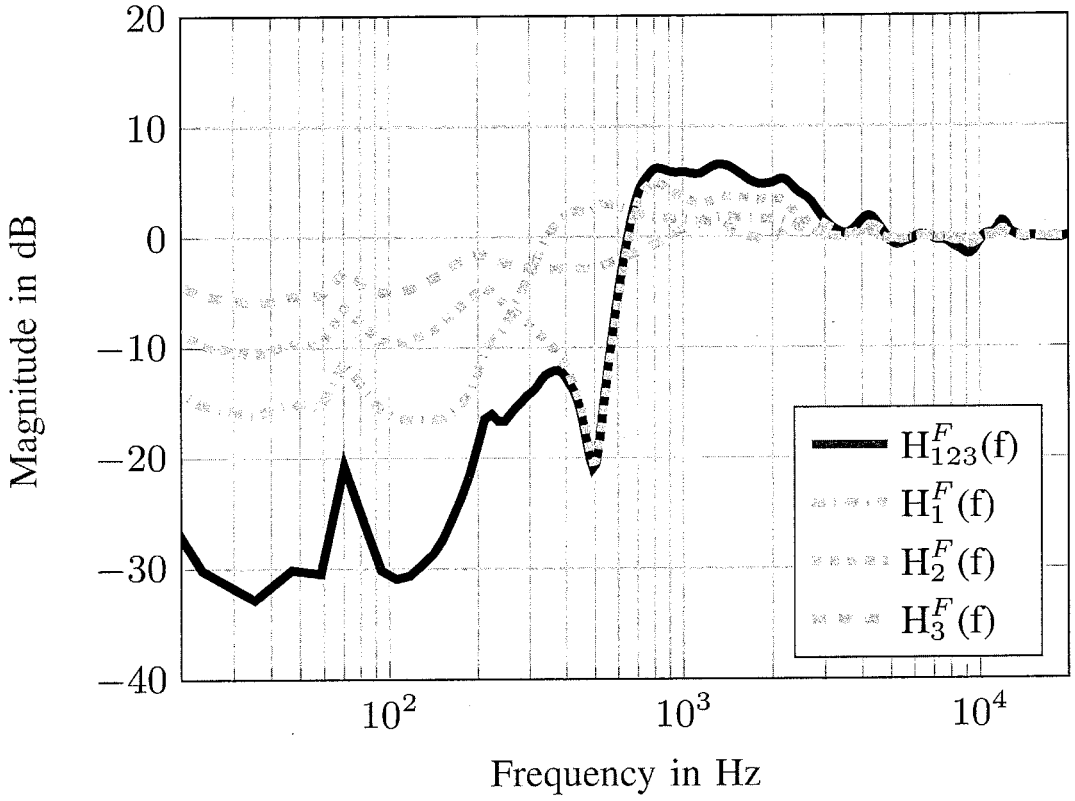
FIG. 5 is a multi-stage feedback controller example with three different MVC-controllers and channel equalization. $H_1^F(f)$, $H_2^F(f)$, and $H_2^F(f)$ are the frequency responses of the individual stages, and $H_{123}^F(f)$ the one of the resulting multi-stage controller.

Depending on the application and how strong variations in the frequency response of the ANC system may be perceived, this effect can be removed or at least minimized. In this case, a good alternative is to apply the proposed channel equalization. In FIG. 5 an example of how F(z) could improve the overall transfer function is presented. It can be seen that the attenuation in the low frequencies remains, while the side effects in the high frequencies have almost completely vanished. Nevertheless, in the mid frequencies a plateau of roughly 6 dB has been produced. Commonly, due to the passive attenuation characteristics of closed headphones, such frequencies should already be attenuated and not be strongly present inside of the ear-cup. However, due to the sensitivity of human beings to that frequency range, the use of the channel equalizer should be evaluated, taking into account the specific headphone and a psychoacoustic model or a listening test.

Figure 6:
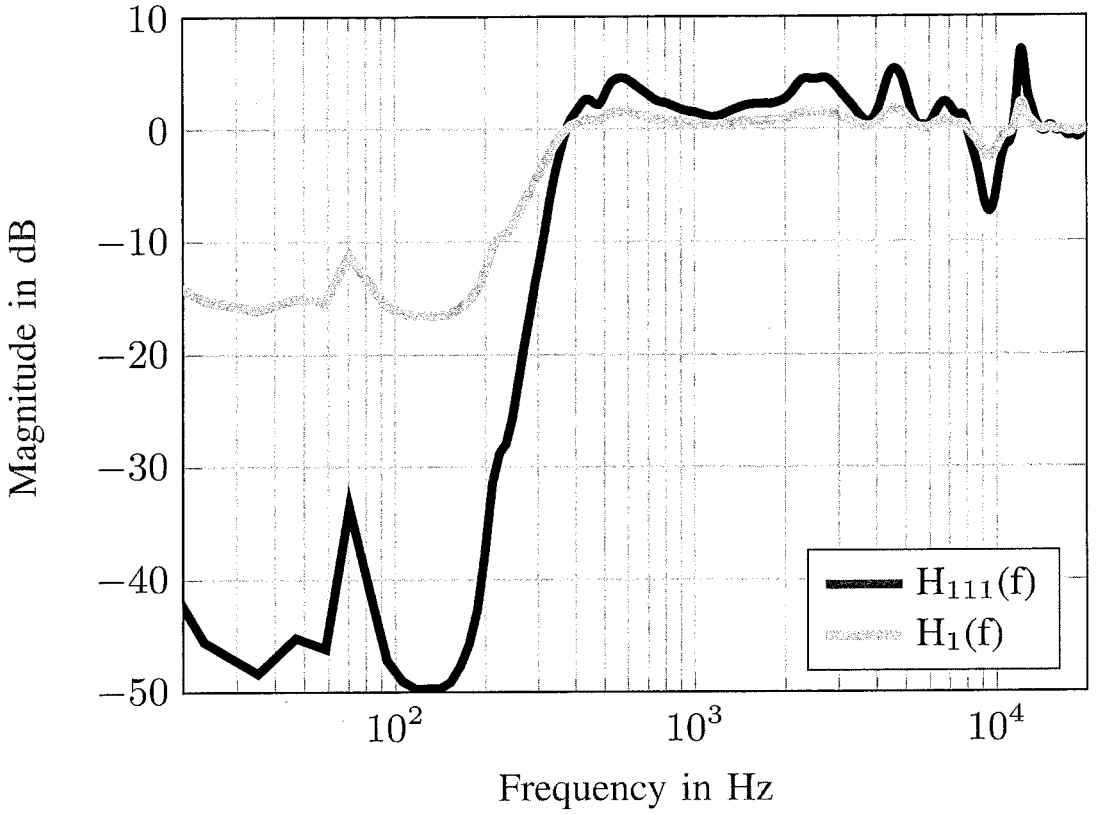
FIG. 6 is a multi-stage feedback controller example with three identical MVC-controllers. $H_1(f)$ is the individual frequency response of one stage, and $H_{111}(f)$ the one of the resulting multi-stage system.

As a further example, the combination of three identical controllers is presented in FIG. 6, where the individual frequency response $H_1(f)$ and the one of the multi-stage controller $H_{111}(f)$ are depicted. In this case, the controller is designed to produce a high attenuation within a narrower bandwidth. This provides just minimal amplifications outside of the attenuation bandwidth. In this case, attenuation values of up to 50 dB within a bandwidth of roughly 400 Hz can be noticed.

Figure 7:
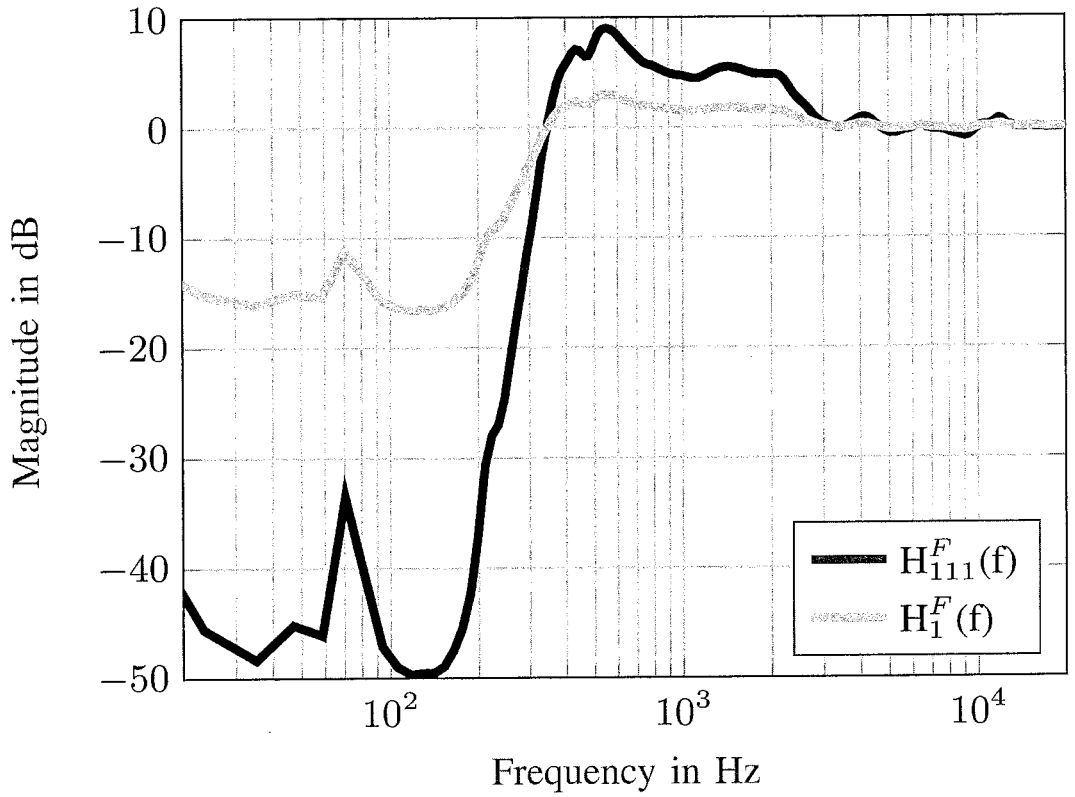
FIG. 7 is a multi-stage feedback controller example with three identical MVC-controllers and channel equalization. $H_1^F(f)$ is the individual frequency response of one stage, and $H_{111}^F(f)$ the one of the resulting multi-stage system.

Although in FIG. 6 the waterbed effect is fairly distributed outside of the attenuation bandwidth, the notch at 9.5 kHz and the peak at 12.2 kHz may cause some annoyance to the listener. In that case, the channel equalizer could help to mitigate the problem, although concentrating it in the mid frequencies now, as shown in FIG. 7. Once again, an evaluation based on a listening test or a psychoacoustic model of the particular headphone should be done, in order to decide on one solution.

In another example with a multi-stage controller according to the invention comprising two MVC control structures, the equations that define a system $$E(z)=D(z)-F(z)S(z)(Y_1(z)+Y_2(z)), \quad (12)$$

$$Y_1(z)=W_1(z)\cdot E(z), \quad (13)$$

$$Y_2(z)=W_2(z)\cdot \hat{E}_1(z), \quad (14)$$

$$\hat{E}_1(z)=E(z)+\hat{Y}_1(z), \quad (15)$$

$$\hat{Y}_1(z)=\hat{S}(z)\cdot \hat{Y}_1(z), \quad (16)$$

are required. By using (13) to replace $Y_1(z)$ in (16), the resulting equation can be used to replace $\hat{Y}_1(z)$ in (15). The resulting definition of $\hat{E}_1(z)$ is then used in (14), so that $Y_2(z)$ can be reformulated as a function of E(z) given by $$Y_2(z)=W_2(z)\cdot(E(z)+\hat{S}(z)\cdot W_1(z)\cdot E(z)) \quad (17)$$

Finally, if (13) and (17) are respectively used to replace $Y_1(z)$, and $Y_2(z)$ in (12), and the condition $\hat{S}(z)=F(z)S(z)$ is met, then the transfer function H(z) of the overall system yields $$\frac{E(z)}{D(z)}=\frac{1}{(1+\hat{S}(z)W_1(z))(1+\hat{S}(z)W_2(z))} \quad (18)$$

As it can be seen, the resulting system transfer function H(z) comprehends a multiplicative combination of the ones of its two sub-systems. No interdependency between controllers is to be found, which enables their independent design and/or optimization.

Figure 8:
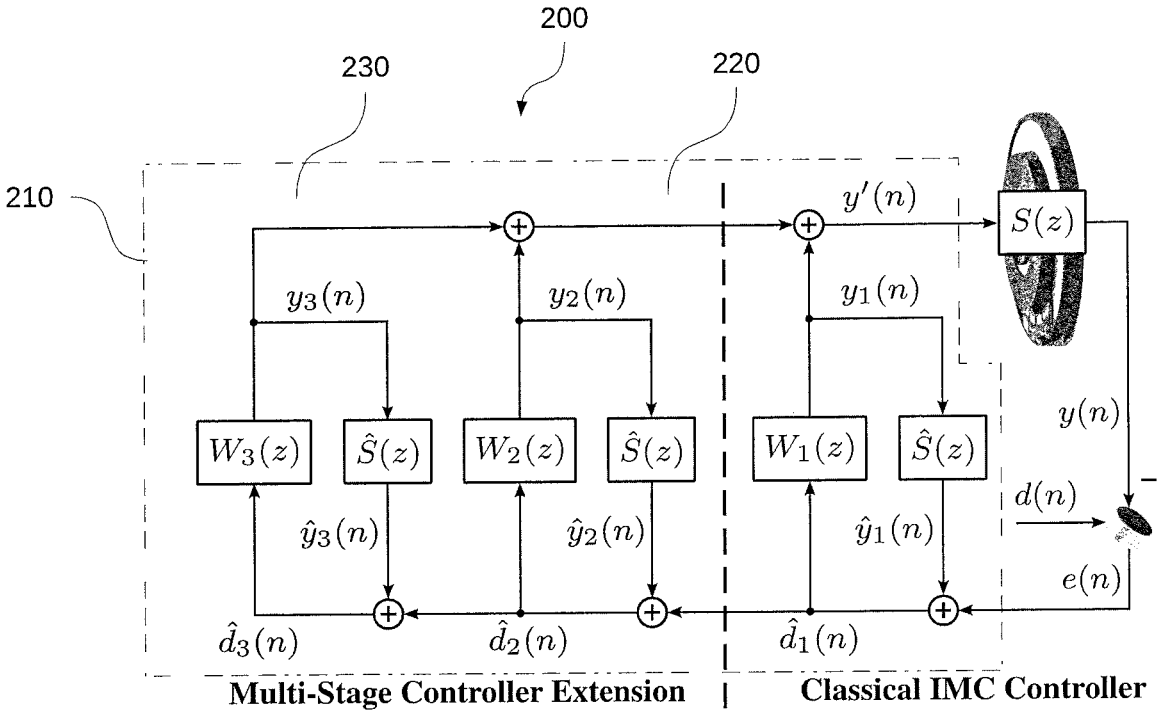
FIG. 8 is a multi-stage feedback controller example based on the classical IMC control scheme and two extension stages. Three different IMC-controllers $W_1(z)$, $W_2(z)$, and $W_3(z)$ are used and $\hat{S}(z)=S(z)$ is chosen.

FIGS. 8 through 11 show details for IMC control structures and in particular relate to the multi-stage system comprising two or more than two IMC control structures. The multi-stage controller according to the invention comprising two or more than two IMC control structures is based on the classical IMC structure as shown in the right side of FIG. 8, with the same signals and systems described in FIG. 1. FIG. 8 shows an ANC-system 200 comprising an ANC-controller 210. The ANC-controller comprises a supplementary second stage structure 220 with an IMC control structure and a supplementary third stage structure 230 with an IMC control structure.

The IMC multi-stage system uses the error signal e(n) and an approximation of its control signal at the error microphone's position $\hat{y}_1(n)$, in order to estimate the disturbance signal d(n). The resulting estimation $\hat{d}_1(n)$ is filtered by the controller $W_1(z)$. The result $y_1(n)$ is fed back through $\hat{S}(z)$ for calculating the next value of $\hat{y}_1(n)$. In the classical IMC control scheme, the output $y_1(n)$ is directly used as control signal y'(n).

Any $k^{th}$ stage in the multi-stage controller extension utilizes the disturbance estimation $d_{k-1}(n)$ of its right neighbor as its own error signal equivalent. It calculates a disturbance estimation $d_k(n)$ and adds its control signal $y_k(n)$ with the cumulated one coming from its left neighbor. In the specific example shown in FIG. 8, the left-most stage's 230 estimated disturbance $\hat{d}_3(n)$ equals to d(n), if $\hat{S}(z)=S(z)$ is chosen. Whereas $\hat{d}_2(n)$ is actually the residual error $d(n)-y_3(n)$ left by $W_3(z)$, and $\hat{d}_1(n)$ the residual error $d(n)-y_3(n)-y_2(n)$ left by $W_3(z)$ and $W_2(z)$ working together. In this sense, the multi-stage IMC structure calculates the residual error left by the incremental system seen at its left, in order to generate a supplementary control signal that further attenuates the disturbance. If a different number of controllers is desired, the second stage's structure 230 can be omitted or repetitions of it can be appended one next to the other.

The effect of such an incremental control loop as ANC system must be analyzed through its transfer function H(z). For this, the equations that define the system $$E(z)=D(z)-S(z)(Y_1(z)+Y_2(z)+Y_3(z)), \tag{19}$$

$$Y_1(z)=W_1(z)\cdot\hat{D}_1(z), \tag{20}$$

$$\hat{D}_1(z)=E(z)+\hat{Y}_1(z), \tag{21}$$

$$\hat{Y}_1(z)=\hat{S}(z)\cdot Y_1(z), \tag{22}$$

$$Y_2(z)=W_2(z)\cdot\hat{D}_2(z), \tag{23}$$

$$\hat{D}_2(z)=\hat{D}_1(z)\cdot\hat{Y}_2(z), \tag{24}$$

$$\hat{Y}_2(z)=\hat{S}(z)\cdot Y_2(z), \tag{25}$$

$$Y_3(z)=W_3(z)\cdot\hat{D}_3(z), \tag{26}$$

$$\hat{D}_3(z)=\hat{D}_2(z)+\hat{Y}_3(z), \tag{27}$$

$$Y_3(z)=\hat{S}(z)\cdot Y_3(z), \tag{28}$$

are required. By using (22) to replace $\hat{Y}_1(z)$ into (21), the resulting equation can further be used to replace $\hat{D}_1(z)$ into (20). The resulting equation is then cleared, so that $Y_1(z)$ can be reformulated as a function of E(z) given by $$Y_1(z)=\frac{W_1(z)E(z)}{1-W_1(z)\hat{S}(z)} \tag{29}$$

Similarly, using (24), (25), (21), (22), and (29) into (23), $Y_2(z)$ can also be expressed as a function of E(z) given by $$Y_2(z)=\frac{W_2(z)E(z)}{(1-W_1(z)\hat{S}(z))(1-W_2(z)\hat{S}(z))} \tag{30}$$

The same procedure can be followed by using (27), (28), (29), and (30) into (26), in order to express $Y_3(z)$ as a function of E(z) given by $$Y_3(z)=\frac{W_3(z)E(z)}{(1-W_1(z)\hat{S}(z))(1-W_2(z)\hat{S}(z))(1-W_3(z)\hat{S}(z))} \tag{31}$$

Finally, if (29), (30), and (31) are respectively used to replace $Y_1(z)$, $Y_2(z)$, and $Y_3(z)$ into (19), and the condition $\hat{S}(z)=S(z)$ is met, then the transfer function of the overall system yields $$\frac{E(z)}{D(z)}=(1-\hat{S}(z)W_1(z))(1-\hat{S}(z)W_2(z))(1-\hat{S}(z)W_3(z)). \tag{32}$$

As it can be seen, the resulting transfer function H(z) comprehends a multiplicative combination of the ones of its individual sub-controllers. No interdependency between controllers is to be found, which enables their independent design and/or optimization.

Figure 9:
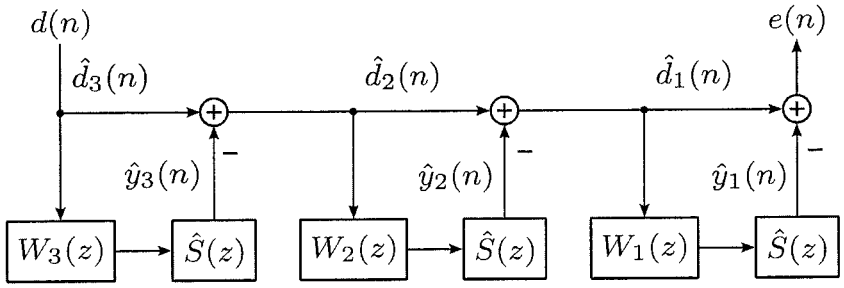
FIG. 9 is a multi-stage feedback controller's equivalent feedforward system. Three different IMC-controllers $W_1(z)$, $W_2(z)$, and $W_3(z)$ are used and $\hat{S}(z)=S(z)$ is chosen.

Based on the resulting overall transfer function H(z) in (32), the equivalent feedforward system of the multi-stage IMC structure is derived and presented in FIG. 9. The figure is very similar to FIG. 3 of the last section, but it comprehends only feedforward stages. In the present figure, the disturbance signal d(n) enters the first stage, where it is approximated by $\hat{d}_3(n)$. The disturbance signal is attenuated by the controller $W_3(z)$, producing a residual disturbance signal $\hat{d}_2(n)$. This residual disturbance is further attenuated by the controllers $W_2(z)$ and $W_3(z)$. The residual error e(n) is then the final remaining noise after all control signals have destructively overlapped with the disturbance signal d(n).

In another example with a multi-stage controller according to the invention comprising two IMC control structures, the equations that define a system $$E(z)=D(z)-S(z)(Y_1(z)+Y_2(z)), \tag{33}$$

$$Y_1(z)=W_1(z)\cdot\hat{D}_1(z), \tag{34}$$

$$\hat{D}_1(z)=E(z)+\hat{Y}_1(z), \tag{35}$$

$$\hat{Y}_1(z)=\hat{S}(z)\cdot Y_1(z), \tag{36}$$

$$Y_2(z)=W_2(z)\cdot\hat{D}_2(z), \tag{37}$$

$$\hat{D}_2(z)=\hat{D}_1(z)+\hat{Y}_2(z), \text{ and} \tag{38}$$

$$\hat{Y}_2(z)=\hat{S}(z)\cdot Y_2(z) \tag{39}$$

are required. By using (36) to replace $\hat{Y}_1(z)$ into (35), the resulting equation can further be used to replace $\hat{D}_1(z)$ into (34). The resulting equation is then cleared, so that $Y_1(z)$ can be reformulated as a function of E(z) given by $$Y_1(z) = \frac{W_1(z)E(z)}{1 - W_1(z)\hat{S}(z)} \tag{40}$$

Similarly, using (38), (39), (35), (36), and (40) into (37), $Y_2(z)$ can also be expressed as a function of E(z) given by $$Y_2(z) = \frac{W_2(z)E(z)}{\left(1 - W_1(z)\hat{S}(z)\right)\left(1 - W_2(z)\hat{S}(z)\right)} \tag{41}$$

Finally, if (40) and (41) are respectively used to replace $Y_1(z)$ and $Y_2(z)$ into (33), and the condition $\hat{S}(z)=S(z)$ is met, then the transfer function H(z) of the overall system yields $$\frac{E(z)}{D(z)} = \left(1 - \hat{S}(z)W_1(z)\right)\left(1 - \hat{S}(z)W_2(z)\right). \tag{42}$$

As it can be seen, the resulting transfer function H(z) also comprehends a multiplicative combination of the ones of its two sub-controllers. No interdependency between controllers is to be found, which enables their independent design and/or optimization.

Figure 10:
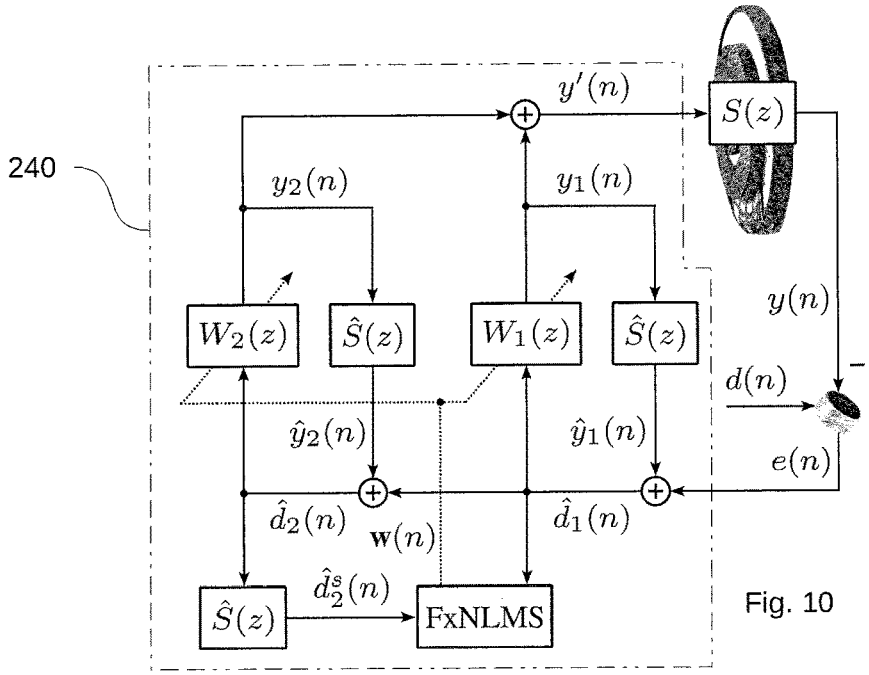
FIG. 10 is a multi-stage feedback controller implementation example based on two stages. The FxNLMS algorithm is used to adapt the controller parameters w(n), which are simultaneously copied to $W_1(z)$ and $W_2(z)$.

In FIG. 10 a possible adaptive implementation of the novel structure is presented. The system with ANC-controller 240 is a two-stage variant, which adapts the Finite Impulse Response (FIR) filter coefficients of $W_2(z)$ and $W_1(z)$ based on the FxNLMS algorithm. In this case, the fact that $\hat{d}_2(n)=d(n)$ and $\hat{d}_1(n)=d(n)-y_2(n)$ is exploited to adaptively derive the optimal solution of the classical IMC-controller, while the two stages are working together. The adaptation algorithm $$w(n+1) = w(n) + \frac{\mu}{\gamma + E_{\hat{d}_2^S}} \cdot \hat{d}_2^S(n) \cdot \hat{d}_1(n) \tag{43}$$

corrects the N filter coefficients w at each sample time, based on the previous N samples of $d_2^S(n)$ and the current value of $\hat{d}_1(n)$. The magnitude of the correction is scaled by the factor $0<\mu/(y\pm E_{\hat{d}2^S})<1$, where $E_{\hat{d}2^S}$ is the energy present in $\hat{d}_2^S(n)$, $\gamma$ is a small number to avoid the division by zero when $E_{\hat{d}2^S}=0$, and $\mu$ is a factor between 0 and 1 known as step-size. Once the calculation of the new w(n+1) coefficients is ready, they are copied simultaneously to $W_2(z)$ and $W_1(z)$ and used during the next sample time for the filtering.

Figure 11A:
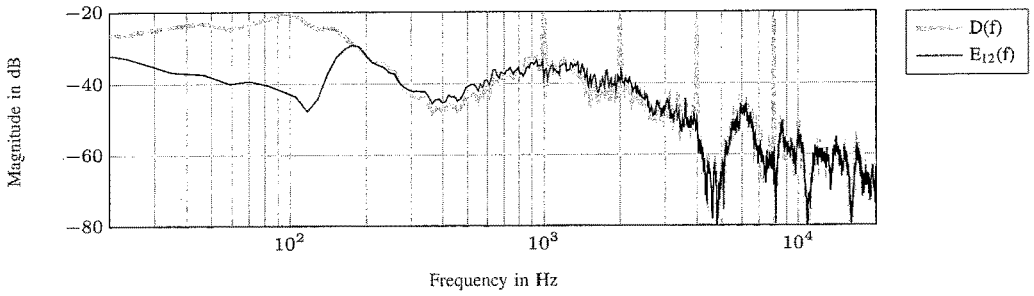
FIG. 11 *a-b* are measured error signals' spectra after 10 minutes of adaptation under (a) the combined control of $W_1(z)$ and $W_2(z)$, and (b) under the control of only $W_1(z)$. Disturbance noise signal D(f) is a uniformly distributed pseudo random noise, which is added with three unequally loud tones at 1 kHz, 2 kHz 4 kHz, and 8 kHz.
Figure 11B:
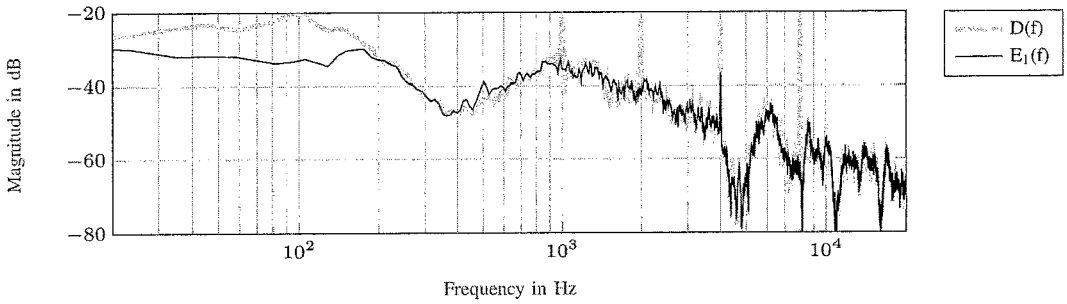

The residual error over frequency $E_{12}(f)$ left by this system after 10 min of adaptation is presented in FIG. 11*a*. As a comparison, the residual error over frequency $E_1(f)$ left by the classical IMC structure under the same conditions is presented in FIG. 11*b*. In both cases the system is disturbed by uniformly distributed white noise and four tones of different frequencies (1 kHz, 2 kHz, 4 kHz, and 8 kHz) and amplitudes. The disturbance measured at the position of the error microphones D(f) is presented in both plots for reference purposes. In FIG. 11*b* the attenuation of the low frequency stochastic component of D(f) can be clearly seen, which reaches a maximum value of 13 dB and is extended up to the 200 Hz. Between the 400-600 Hz range a slightly amplification can be seen. Interesting is to see that the tones are attenuated until they have reached the level of the stochastic component, although in the case of the 4 kHz tone, the system managed to just partially attenuate it. In FIG. 11*a* the attenuation bandwidth of the low frequency stochastic component of D(f) remains roughly the same, but the attenuation values have been notoriously increased, reaching a maximum of 24 dB. The small amplification in the 400-600 Hz range seen in FIG. 11*b* has increased its bandwidth. Although the attenuation of the tones do not go below the level of the stochastic component, even when using the novel structure, the 4 kHz tone has been now completely attenuated. This and the improved attenuation of the low frequencies can be explained by the combination of the attenuation performance of the two IMC-controllers together.

FIGS. 12*a*-12*c* and 13 show details for IMC control structures MVC control structures and FF control structures in an interconnected design. In particular FIGS. 12*a*-12*c* and 13 relate to the multi-hybrid system comprising a combination of IMC control structures, MVC control structures and FF control structures according to the invention. The multi-hybrid ANC systems 300, 400, 500 comprise ANC-controllers 310, 410, 510 which each comprise a combination of MVC control structures, IMC control structures and FF control structures which are interconnected to provide a suitable control signal y'(n) for controlling an acoustic speaker in the target area. Implementations of MVC control structures, IMC control structures and FF control structures, which could be used for the control structures in this application are described in the cited references [1] to [26]. For that purpose these cited references are explicitly referred to.

Based on the principles explained in the previous sections, stages of different kind of control structures can be combined into one system. Thus, multi-hybrid control structures can be built, like the ones shown in FIG. 12*a*-12*c*. Here a FF-controller $W_{ff}(z)$ extends with different strategies the hybrid feedback controller built based on an MVC and IMC scheme, with the controllers $W_{mvc}(z)$ and $W_{imc}(z)$, respectively.

The advantage of hybrid control is that limitations of one strategy can partially be compensated by the other two remaining ones. For instance, the transfer function of the system presented in FIG. 12*a*

$$H_1(z) = \frac{E(z)}{X(z)} = \frac{(P(z) - S(z)W_{ff}(z))\left(1 - \hat{S}(z)W_{imc}(z)\right)}{1 + S(z)W_{mvc}(z)} \tag{44}$$

yields the multiplicative combination of the transfer functions of all control schemes if the equality $\hat{S}(z)=S(z)$ holds. With this system, controllers can be designed and optimized independently, without drifting the others from their individual optimum. The application of this strategy on ANC headphones without spectral weighting cause that all optimum solutions concentrate their attenuation in the low-frequency range. Thus, after the combination of all controllers is applied, a relative stronger high-frequency content remains. In order to partially avoid this, the structure presented in FIG. 12*b* can be used. Here, the MVC substructure is used to apply control over the disturbance signal seen by the FF-controller. By looking at its transfer function $$H_2(z) = \frac{E(z)}{X(z)} = \left(1 - \hat{S}(z)W_{imc}(z)\right)\left(\frac{P(z)}{1 + S(z)W_{mvc}(z)} - S(z)W_{ff}(z)\right) \tag{45}$$

it can be seen that the effective primary path is shaped by the transfer function of the MVC control loop. This produces a change in the optimal solution of the FF-controller, which now aims to attenuate a disturbance with less energy content in the low-frequency region. This strategy can be further extended as presented in FIG. 12*c*, with the inclusion of the IMC feedback loop. In its transfer function $$H_3(z) = \frac{E(z)}{X(z)} = \frac{P(z)\left(1 - \hat{S}(z)W_{imc}(z)\right)}{1 + S(z)W_{mvc}(z)} - S(z)W_{ff}(z) \tag{46}$$

it can be seen that both feedback stages combine together for the pre-attenuation of the disturbance signal. The residual error contains then all frequencies that cannot be attenuated by the feedback schemes. Thus, with this structure the FF optimum solution basically aims to compensate for the limitations of its feedback counterparts.

Figure 12A:
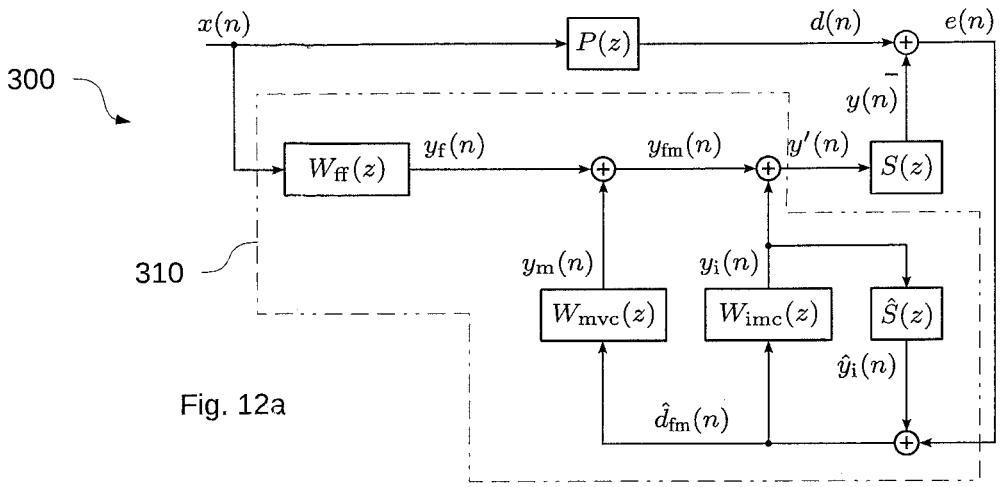
FIG. 12 *a-c* are multi-hybrid structures combining stages of a FF-controller $W_{ff}(z)$, an IMC-controller $W_{imc}(z)$, and an MVC-controller $W_{mvc}(z)$. The FF-controller's optimum is in (a) completely independent from the feedback controllers; in (b) a dependency on $W_{mvc}(z)$ is built; and in (c) a dependency on $W_{mvc}(z)$ and $W_{imc}(z)$ is built.

In FIG. 12*a* the multi-hybrid ANC system 300 is presented, which comprises the ANC-controller 310. This ANC-controller implements an interconnection strategy of control structures that yields an independent solution for their individual optimal design. In FIG. 12*a* the FF control structure can be seen on the left-side, comprising a FF-controller $W_{ff}(z)$ that uses the ambient noise signal x(n) as input for calculating its control signal $y_f(n)$. This control signal is then combined with the control signal $y_m(n)$ provided by the MVC control structure located in the middle. The MVC control structure comprises an MVC-controller $W_{mvc}(z)$, which in this particular interconnection strategy is fed with the signal $\hat{d}_{fm}(n)$. The combined control signal $y_{fm}(n)$ is then added to the control signal $y_i(n)$ coming from the IMC control structure located at the right-side, in order to calculate the control signal y'(n). The IMC control structure comprises an IMC-controller $W_{imc}(z)$ and a secondary path estimate filter $\hat{S}(z)$. The IMC control structure uses its control signal $y_i(n)$ together with the secondary path estimate filter $\hat{S}(z)$, in order to modify the residual error signal e(n), before the result is used by the IMC-controller $W_{imc}(z)$ as input for a new calculation of the control signal $y_i(n)$.

Figure 12B:
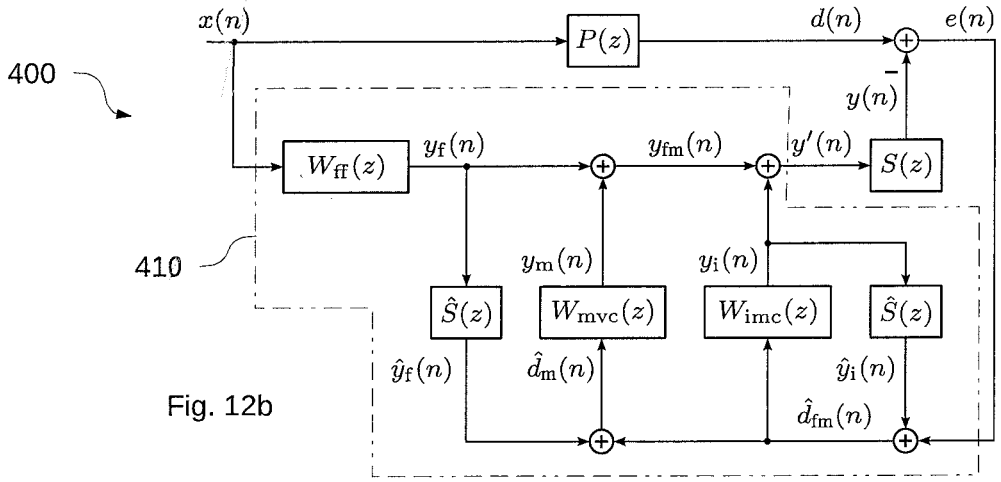

In FIG. 12*b* the multi-hybrid ANC system 400 is presented, which comprises the ANC-controller 410. This ANC-controller implements an interconnection strategy of control structures that yields an independent solution for the IMC-controller, but a solution for the FF-controller which depends on the MVC control structure for its design. In FIG. 12*b* the FF control structure can be seen on the left-side, comprising a FF-controller $W_{ff}(z)$ that uses the ambient noise signal x(n) as input for calculating its control signal $y_f(n)$. This control signal is used on the one hand as input for a secondary path estimate filter $\hat{S}(z)$ to calculate the signal $\hat{y}_f(n)$. On the other hand, $y_f(n)$ is also used for calculating $y_{fm}(n)$ by combining it with the control signal $y_m(n)$ provided by the MVC control structure located in the middle. The MVC control structure comprises an MVC controller $W_{mvc}(z)$, which in this particular interconnection strategy is fed with the signal $\hat{d}_m(n)$. This signal is the result of the addition of $\hat{y}_f(n)$ and the signal $\hat{d}_{fm}(n)$. The combined control signal $y_{fm}(n)$ is then added to the control signal $y_i(n)$ coming from the IMC control structure located at the right-side, in order to calculate the control signal y'(n). The IMC control structure comprises an IMC-controller $W_{imc}(z)$ and a secondary path estimate filter $\hat{S}(z)$. The IMC control structure uses its control signal $y_i(n)$ together with the secondary path estimate filter $\hat{S}(z)$, in order to modify the residual error signal e(n), before the result is used by the IMC-controller (z) as input for a new calculation of the control signal $y_i(n)$.

Figure 12C:
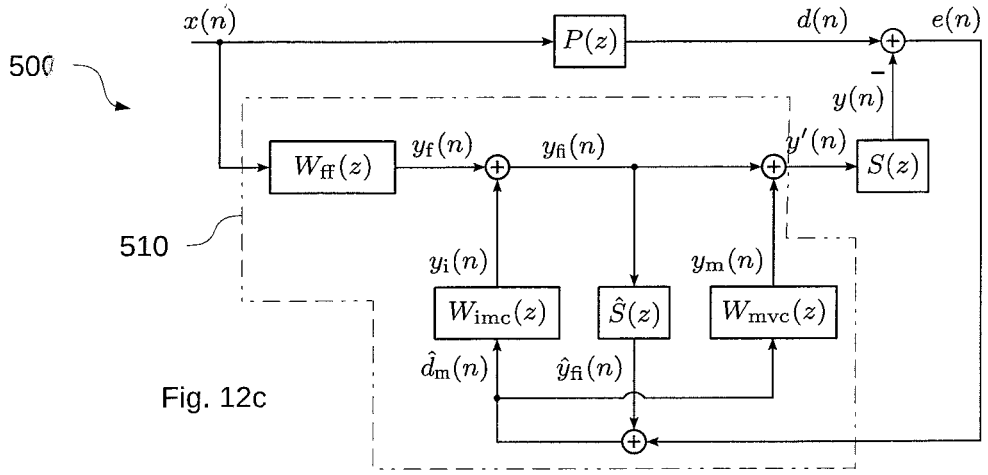

In FIG. 12*c* the multi-hybrid ANC system 500 is presented, which comprises the ANC-controller 510. This ANC-controller implements an interconnection strategy of control structures that yields a solution for the FF-controller which depends on the MVC control structure and IMC control structure for its design. In FIG. 12*c* the FF control structure can be seen on the left-side, comprising a FF-controller $W_{ff}(z)$ that uses the ambient noise signal x(n) as input for calculating its control signal $y_f(n)$. This signal is combined with the control signal $y_i(n)$ coming from the IMC control structure, located in the middle. The IMC control structure comprises an IMC-controller $W_{imc}(z)$ and a secondary path estimate filter $\hat{S}(z)$. The IMC control structure uses in this specific control strategy the combined control signal $y_{fi}(n)$ together with the secondary path estimate filter $\hat{S}(z)$, in order to modify the residual error signal e(n). The resulting signal $\hat{d}_m(n)$ is used by the IMC-controller $W_{imc}(z)$ as input for a new calculation of the control signal $y_i(n)$. The combined control signal $y_{fi}(n)$ is further combined with $y_m(n)$ coming from the MVC control structure at the right side, in order to calculate the control signal y'(n). In this specific control strategy, MVC control structure which comprises only the MVC-controller $W_{mvc}(z)$, is fed with the signal $\hat{d}_m(n)$ in order to calculate its control signal $y_m(n)$.

Figure 13:
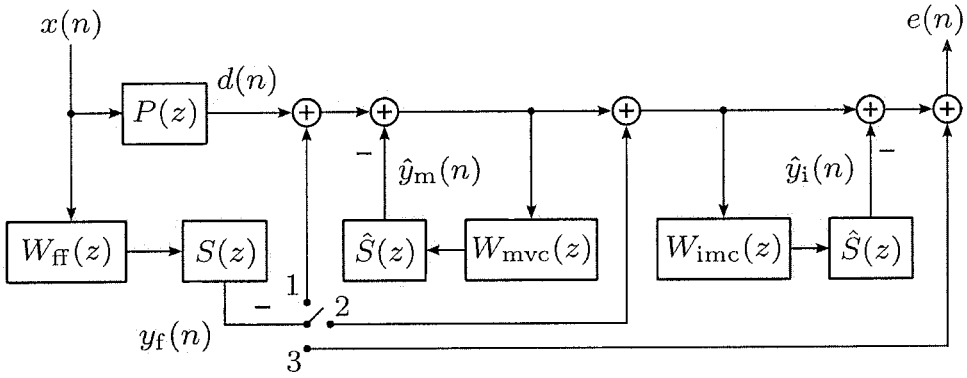
FIG. 13 is a multi-hybrid controller structures' equivalent feedforward system. Three different controllers types $W_{ff}(z)$, $W_{mvc}(z)$, and $W_{imc}(z)$ are used and $\hat{S}(z)=S(z)$ is chosen. If $y_f(n)$ is connected to position 1, the system is equivalent to the one in FIG. 12*a*. If instead it is connected to position 2, the system is equivalent to the one presented in FIG. 12*b*. If the signal is connected to position 3, then the system is equivalent to the one in FIG. 12*c*. If $y_f(n)$ is not connected to any position, then the system simplifies to the one from Schumacher in reference [6].

Based on the three presented transfer functions, an equivalent feedforward system is depicted in FIG. 13. If $y_f(n)$ is connected to the switch's position 1, the system is equivalent to the one in FIG. 12*a*. If instead it is connected to position 2, the system is equivalent to the one presented in FIG. 12*b*. If the signal is connected to position 3, then the system is equivalent to the one in FIG. 12*c*. If $y_f(n)$ is not connected to any position, then the system simplifies to the one from Schumacher in reference [6].

In conclusion, the invention proposes multi-stage and multi-hybrid control strategies, which combine the attenuation (and amplification) of the individual stages, without the need of extra transducers. The application of the strategy to the MVC and IMC-controller structures has been exemplified such that by omitting or duplicating the middle stage, the number of stages can be respectively decreased or increased.

By combining MVC stages with the multi-stage strategy, higher attenuation levels can be reached and a higher degree of freedom during the design is achieved. A new module called channel equalizer is proposed for the application on MVC stages, which combined with the novel structure minimize and shape the waterbed effect. With four design cases it has been exemplified, how the structure and the channel equalizer can provide more design flexibility and produce higher noise attenuation levels.

Based on the multi-stage strategy, the possibilities that the IMC structure offers as adaptive system are further exploited in an implementation example. This has shown that the structure can provide higher attenuation values within the same adaptation time, without having to adapt each controller separately. Moreover, more conservative adaptation parameters can be chosen, while producing comparable results with lower risk of instability.

Based on the principles introduced together with the multi-stage strategy, multi-hybrid control structures have been developed. These structures combine stages of different control schemes, in order to overcome the limitations of the individual ones. Based on different connection strategies, the optimal solution of the individual controllers can be coinfluenced, in order to extend the attenuation bandwidth beyond the low-frequency region.

It shall be understood, that the embodiments and found solutions of the invention presented above are not only limited to ANC-systems for headphones but are also suitable for other applications in which ambient noise or structural vibrations are to be attenuated. It also goes without saying that the details explained for the individual embodiments are interchangeable to certain extends and can be supplemented with one another, as well understood by a person skilled in this technical field. For reasons of clarity and to avoid unnecessary repetitions, the description of further advantageous combinations of control structures has been omitted.

REFERENCE SIGNS

10 ANC-controller
12 Ear-cup
14 Reference microphone
16 Error microphone
18 Noise in the vicinity of the target area
20 Speaker in the target area
22 Target area
100 ANC system
110 ANC-controller
120 Supplementary second MVC control structure stage
130 Supplementary third MVC control structure stage
200 ANC system
210 ANC-controller
220 Supplementary second IMC control structure stage
230 Supplementary third IMC control structure stage
240 ANC-controller
300 ANC system
310 ANC-controller
400 ANC system
410 ANC-controller
500 ANC system
510 ANC-controller

LITERATURE REFERENCES

[1] A. H. Sayed, Fundamentals of Adaptive Filtering, 1st ed. Wiley-IEEE Press, June 2003.

[2] M. Pawelczyk, S. Elliott, and B. Rafaely, "Active noise control using feedback. Fixed and adaptive controllers," December 1997. [Online]. Available: http://eprints.soton.ac.uk/379823/[3]

[3] M. Pawelczyk, "Analogue active noise control," Applied Acoustics, vol. 63, no. 11, pp. 1193-1213, 2002.

[4] B. Rafaely, "Active noise reducing headset—An overview," INTER-NOISE and NOISE-CON Congress and Conference Proceedings, vol. 2001, no. 3, pp. 2144-2153, 2001.

[5] S. J. Elliot, Signal Processing for Active Control, ser. Signal Processing and its Applications. London: Academic Press, 2001.

[6] T. Schumacher, H. Krüger, M. Jeub, P. Vary, and C. Beaugeant, "Active noise control in headsets: A new approach for broadband feedback ANC," in 2011 IEEE International Conference on Acoustics, Speech and Signal Processing (ICASSP), May 2011, pp. 417-420.

[7] P. Rivera Benois, P. Nowak, and U. Zölzer, "Fully Digital Implementation of a Hybrid Feedback Structure for Broadband Active Noise Control in Headphones," in 2017 Proceedings of the 24th International Congress on Sound and Vibration, July 2017.

[8] T. Tay and J. Moore, "Enhancement of fixed controllers via adaptive-q disturbance estimate feedback," Automatica, vol. 27, no. 1, pp. 39 53, 1991.

[9] S. J. Elliott, "Adaptive feedback controllers," in Signal Processing for Active Control, ser. Signal Processing and its Applications, S. J. Elliott, Ed. London: Academic Press, 2001, ch. 7.

[10] M. Pawelczyk, "A hybrid active noise control system," Archives of Control Sciences, vol. 13, no. 2, pp. 191-213, 2003.

[11] Y. Song, Y. Gong, and S. M. Kuo, "A robust hybrid feedback active noise cancellation headset," IEEE Transactions on Speech and Audio Processing, vol. 13, no. 4, pp. 607-617, July 2005.

[12] X. Kong, P. Liu, and S. M. Kuo, "Multiple channel hybrid active noise control systems," IEEE Transactions on Control Systems Technology, vol. 6, no. 6, pp. 719-729, November 1998.

[13] C. H. Hansen, Understanding Active Noise Cancellation. London: Spon Press, 2001.

[14] L. Wu, X. Qiu, I. S. Burnett, and Y. Guo, "Decoupling feedforward and feedback structures in hybrid active noise control systems for uncorrelated narrowband disturbances," Journal of Sound and Vibration, vol. 350, pp. 1-10, 2015.

[15] P. Rivera Benois, P. Nowak, and U. Zölzer, "Evaluation of a decoupled feedforward-feedback hybrid structure for active noise control headphones in a multi-source environment," in Proceedings of the 46$^{th}$ International Congress and Exposition on Noise Control Engineering, INTER-NOISE, August 2017.

[16] K. M. Sen and D. R. Morgan, Active Noise Control Systems: Algorithms and DSP Implementations, ser. Telecommunications and Signal Processing. New York: John Wiley & Sons, Inc, 1996.

[17] S. Johansson, M. Winberg, T. Lago, and I. Claesson, "A New Active Headset For a Helicopter Application," in 1997 Proceedings of the 5$^{th}$ International Congress on Sound and Vibration, December 1997.

[18] W.-K. Tseng, B. Rafaely, and S. J. Elliott, "Combined feedbackfeedforward active control of sound in a room," The Journal of the Acoustical Society of America, vol. 104, no. 6, pp. 3417-3425, 1998. [Online] Available: http://dx.doi.org/10.1121/1.423925

[19] Y.-K. Chong, L. Wang, S.-C. Ting, and W.-S. Gan, "Integrated headsets using the adaptive hybrid active noise control system," in 2005 5th International Conference on Information Communications Signal Processing, 2005, pp. 1324-1328.

[20] T. Wang, W. S. Gan, and Y. K. Chong, "Psychoacoustic hybrid active noise control system," in 2012 IEEE International Conference on Acoustics, Speech and Signal Processing (ICASSP), March 2012, pp. 321-324.

[21] C. Cantle, "The third principle of active control: The feed forback," INTER-NOISE and NOISE-CON Congress and Conference Proceedings, vol. 1999, no. 5, pp. 885-896, 1999.

[22] B. Rafaely and M. Jones, "Combined feedback-feedforward active noisereducing headset—the effect of the acoustics on broadband performance," The Journal of the Acoustical Society of America, vol. 112, no. 3, pp. 981-989, 2002.

[23] L. Håkansson, S. Johansson, M. Dahl, P. Sjisten, and I. Claesson, "Noise cancelling headsets for speech communication," in Noise Reduction in Speech Applications, G. M. Davis, Ed. London: CRC Press, 2002, ch. 12, pp. 305-328.

[24] A. D. Streeter, L. R. Ray, and R. D. Collier, "Hybrid feedforwardfeedback active noise control," in Proceedings of the 2004 American Control Conference, vol. 3, June 2004, pp. 2876-2881 vol. 3.

[25] H. Foudhaili, "Kombinierte feedback- and adaptive Feedforward-Regelung für aktive Lärmreduktion in einem Kommunikations-Headset," Ph.D. dissertation, Leibniz Universität a Hannover, Aachen, 2008.

[26] P. Rivera Benois, V. Papantoni, and U. Zölzer, "Psychoacoustic Hybrid Active Noise Control Structure for Application in Headphones," in 2018 Proceedings of the 25th International Congress on Sound and Vibration, July 2018

The invention claimed is:

1. An active noise cancellation system (300, 400, 500) for reducing unwanted noise in a target area (22) by attenuating a disturbance noise signal (d(n)), which is the remaining noise in the target area (22) originated from an ambient noise signal (x(n)) present in the vicinity of the target area (22) that is transferred to the target area via a main path described by a transfer function (P(z)), the active noise cancellation system (300, 400, 500) comprising a processing unit that implements an ANC-controller (310, 410, 510) which is configured to provide a control signal (y'(n)) for controlling a speaker (20) in the target area (22) in order to generate an acoustic signal (y(n)) that destructively overlaps with the disturbance noise signal (d(n)) and thereby attenuates the same, wherein the control signal (y'(n)) is transferred into the acoustic signal (y(n)) via a secondary path described by a transfer function (S(z)), and wherein the ANC-controller provides a system transfer function (H(z)), which minimizes a residual error signal (e(n)), wherein the residual error signal (e(n)) represents the difference between the acoustic signal (y(n)) and the disturbance noise signal (d(n)) after a destructive overlap of the same, wherein the ANC-controller (310, 410, 510) comprises a control structure which consist of an Internal Model Control (IMC) feedback control structure (IMC control structure) comprising an IMC-controller ($W_{imc}(z)$) and a secondary path estimate filter described by a transfer function ($\hat{S}(z)$), a Minimum Variance Control (MVC) feedback control structure (MVC control structure) comprising a MVC-controller ($W_{mvc}(z)$) and a feedforward (FF) control structure (FF control structure) comprising a FF-controller ($W_{ff}(z)$), and wherein the IMC control structure, the MVC control structure and the FF control structure are interconnected and combined to form a common multi-hybrid control system.

2. The active noise cancellation system (300, 400, 500) according to claim 1, wherein the ANC-controller (310, 410, 510) is configured such that the ambient noise signal (x(n)) is filtered by the FF-controller ($W_{ff}(z)$) providing a feedforward control signal ($y_f(n)$) which is then combined with a feedback control signal ($y_m(n)$) provided by the MVC-controller ($W_{mvc}(z)$) and a feedback control signal ($y_i(n)$) provided by the IMC-controller ($W_{imc}(z)$), wherein the resulting control signal (y'(n)) is transferred by the secondary path (S(z)) in order to provide the acoustic signal (y(n)) which destructively overlaps with the disturbance noise signal (d(n)).

3. The active noise cancellation system (300) according to claim 1, wherein the ANC-controller (310) is configured such that the residual error signal (e(n)) is combined with an output signal ($\hat{y}_i(n)$) provided by the secondary path estimate filter ($\hat{S}(z)$), the resulting signal ($\hat{d}_{fm}(n)$) is then fed into the IMC-controller ($W_{imc}(z)$) and it is further fed into the MVC-controller ($W_{mvc}(z)$), and wherein an output signal ($y_i(n)$) provided by the IMC-controller ($W_{imc}(z)$) is fed into the secondary path estimate filter ($\hat{S}(z)$) and the output signal ($y_i(n)$) is further combined with a signal ($y_{fm}(n)$) resulting from a combination of the output ($y_f(n)$) of the FF-controller ($W_{ff}(z)$) and the output signal ($y_m(n)$) provided by the MVC-controller ($W_{mvc}(z)$), in order to provide the control signal (y'(n)).

4. The active noise cancellation system (400) according to claim 1, wherein the ANC-controller (410) is configured such that the residual error signal (e(n)) is combined with an output signal ($\hat{y}_i(n)$) provided by a first one of the secondary path estimate filter ($\hat{S}(z)$), the resulting signal ($\hat{d}_{fm}(n)$) is fed into the IMC-controller ($W_{imc}(z)$) and the resulting signal ($\hat{d}_{fm}(n)$) is further combined with an output signal ($\hat{y}_f(n)$) provided by a second one of the secondary path estimate filter ($\hat{S}(z)$), the resulting combined signal ($\hat{d}_m(n)$) is fed into the MVC-controller ($W_{imc}(z)$), and wherein an output signal ($y_{fm}$ (n)) provided by the IMC-controller ($W_{imc}(z)$) is fed into the first one of the secondary path estimate filter ($\hat{S}(z)$) and the output signal ($y_i(n)$) is further combined with a signal ($y_{fm}(n)$) resulting from a combination of the output signal ($y_f(n)$) of the FF-controller ($W_{ff}(z)$) and the output signal ($y_m(z)$) provided by the MVC-controller ($W_{mvc}(z)$) in order to provide the control signal (y'(n)), and wherein the output signal ($y_f(n)$) is fed into the second one of the secondary path estimate filter ($\hat{S}(z)$).

5. The active noise cancellation system (500) according to claim 1, wherein the ANC-controller (510) is configured such that the residual error signal (e(n)) is combined with an output signal ($\hat{y}_{fi}(n)$) provided by the secondary path estimate filter ($\hat{S}(z)$), the resulting signal ($\hat{d}_m(z)$) is fed into the IMC-controller ($W_{imc}(z)$) and it is further fed into the MVC-controller ($W_{mvc}(z)$), and wherein an output signal ($y_i(n)$) provided by the IMC-controller ($W_{imc}(z)$) is combined with an output signal ($y_f(n)$) provided by the FF-controller ($W_{ff}(z)$), the resulting combined signal ($y_{fi}(n)$) is then fed into the secondary path estimate filter ($\hat{S}(z)$) and the resulting combined signal ($y_{fi}(n)$) is further combined with an output signal ($y_m(n)$) provided by the MVC-controller ($W_{mvc}(z)$), in order to provide the control signal (y'(n)).

6. A method for actively cancelling unwanted noise in a target area utilizing an active noise cancelling system according to claim 1, comprising an ANC-controller which provides a system transfer function (H(z)) which minimizes a residual error signal (e(n)) representing the difference between an acoustic signal (y(n)) and a disturbance noise signal (d(n)) after a destructive overlap of the same, the method comprising the steps:

a) generating the acoustic signal (y(n)) in the target area which overlaps with the disturbance noise signal (d(n)) present in the target area, b) receiving the residual error signal (e(n)) representing the difference between the acoustic signal (y(n)) and the disturbance noise signal (d(n)) after a destructive overlap of the same, c) generating a control signal (y'(n)) for controlling a speaker (20) in the target area (22) such that the acoustic signal (y(n)) is shaped to minimize the residual error signal (e(n)).

7. The active noise cancellation system (300) according to claim 1, wherein the IMC control structure, the MVC control structure and the FF feedforward control structure are interconnected such that if the equality $\hat{S}(z)=S(z)$ holds, $t_h$en the system transfer function (H(z)), which in this embodiment is the analytic relationship derived from the system's components between the residual error signal (e(n)) in Z-Transform domain (E(z)) and the ambient noise signal (x(n)) in Z-Transform domain (X(z)), comprises a multiplicative combination of the transfer function of the IMC control structure, the transfer function of the MVC control structure, and the transfer function of the FF control structure, wherein the system transfer function (H(z)) corresponds to:

$$\frac{E(z)}{X(z)} = \frac{(P(z) - S(z)W_{ff}(z))(1 - S(z)W_{imc}(z))}{1 + S(z)W_{mvc}(z)}.$$

8. The active noise cancellation system (400) according to claim 1, wherein the IMC control structure, the MVC control structure and the FF feedforward control structure are interconnected such that if the equality $\hat{S}(z)=S(z)$ holds, then the system transfer function (H(z)), which in this embodiment is the analytic relationship derived from the system's components between the residual error signal (e(n)) in Z-Transfoim domain (E(z)) and the ambient noise signal (x(n)) in Z-Transform domain (X(z)), corresponds to a multiplicative combination of the transfer function of the IMC control structure and the transfer function of a hybrid sub-structure of the ANC-controller comprising the transfer function of the MVC control structure and the FF controller, wherein the system transfer function (H(z)) corresponds to:

$$\frac{E(z)}{X(z)} = (1 - S(z)W_{imc}(z))\left(\frac{P(z)}{1 + S(z)W_{mvc}(z)} - S(z)W_{ff}(z)\right).$$

9. The active noise cancellation system (500) according to claim 1, wherein the IMC control structure, the MVC control structure and the FF control structure are interconnected such that if the equality $\hat{S}(z)=S(z)$ holds, then the system transfer function (H(z)), which is the analytic relationship derived from the system's components between the residual error signal (e(n)) in Z-Transform domain (E(z)) and the ambient noise signal (x(n)) in Z-Transform domain (X(z)), comprises the transfer function of the FF control structure and a multiplicative combination of the transfer function of the IMC control structure and the transfer function of the MVC control structure, wherein the system transfer function (H(z) corresponds to:

$$\frac{E(z)}{X(z)} = \frac{P(z)(1 - S(z)W_{imc}(z))}{1 + S(z)W_{mvc}(z)} - S(z)W_{ff}(z).$$

10. An active noise cancellation system (200) for reducing unwanted noise in a target area (22) by attenuating a disturbance noise signal (d(n)), which is the remaining noise in the target area (22) originated from an ambient noise signal (x(n)) present in the vicinity of the target area (22) that is transferred to the target area (22) via a main path described by a transfer function (P(z)), the active noise cancellation system (200) comprising a processing unit that implements an ANC-controller (210) which is configured to provide a control signal (y'(n)) for controlling a speaker in the target area (22) in order to generate an acoustic signal (y(n)) that destructively overlaps with the disturbance noise signal (d(n)) and thereby attenuates the same, wherein the control signal (y'(n)) is transferred into the acoustic signal (y(n)) via a secondary path described by a transfer function (S(z)), and wherein the ANC-controller provides a system transfer function (H(z)), which minimizes a residual error signal (e(n)), wherein the residual error signal (e(n)) represents the difference between the acoustic signal (y(n)) and the disturbance noise signal (d(n)) after a destructive overlap of the same, wherein the ANC-controller (210) comprises a control structure which consist of at least two Internal Model Control (IMC) feedback control structures (IMC control structures), each comprising an IMC-controller ($W_{imc}(z)$) and a secondary path estimate filter described by a transfer function ($\hat{S}(z)$), and wherein the IMC control structures are interconnected and combined to form a common multi-stage control system.

11. The active noise cancellation system (200) according to claim 10, wherein a classical IMC control structure is extended by a supplementary second stage structure (220), each comprising an IMC-controller ($W_1(z)$, $W_2(z)$), are interconnected such that if the equality $\hat{S}(z)=S(z)$ holds, then their associated system transfer function (H(z)), which in this embodiment is the analytic relationship derived from the system's components between the residual error signal (e(n)) in Z-Transform domain (E(z)) and the disturbance noise signal (d(n)) in Z-Transform domain (D(z)), corresponds to:

$$\frac{E(z)}{D(z)} = (1 - S(z)W_1(z))(1 - S(z)W_2(z)).$$

12. The active noise cancellation system (200) according to claim 11, wherein the multi-stage control system comprises n additional IMC control structures, each comprising an IMC-controller ($W_n(z)$), wherein the IMC control structures are interconnected and combined with each other such that if the equality $\hat{S}(z)=S(z)$ holds, then each additional IMC control structure extends the system transfer function (H(z)) by the multiplicative term:

$$(1-S(z)W_n(z)).$$

13. An active noise cancellation system (100) for reducing unwanted noise in a target area (22) by attenuating a disturbance noise signal (d(n)), which is the remaining noise in the target area (22) originated from an ambient noise signal (x(n)) present in the vicinity of the target area (22) that is transferred to the target area (22) via a main path described by a transfer function (P(z)), the active noise cancellation system (100) comprising a processing unit that implements an ANC-controller (110) which is configured to provide a control signal (y'(n)) for controlling a speaker in the target area (22) in order to generate an acoustic signal (y(n)) that destructively overlaps with the disturbance noise signal (d(n)) and thereby attenuates the same, wherein the control signal (y'(n)) is transferred into the acoustic signal (y(n)) via a secondary path described by a transfer function (S(z)), and wherein the ANC-controller (110) provides a system transfer function (H(z)), which minimizes a residual error signal (e(n)), wherein the residual error signal (e(n)) represents the difference between the acoustic signal (y(n)) and the disturbance noise signal (d(n)) after a destructive overlap of the same, wherein the ANC-controller (110) comprises a control structure which consist of at least two Minimum Variance Control (MVC) feedback control structures, each comprising a MVC-controller ($W_{mvc}(z)$) and a secondary path estimate filter described by a transfer function ($\hat{S}(z)$), and wherein the MVC control structures are interconnected and combined to form a common multi-stage control system.

14. The active noise cancellation system (100) according to claim 13, wherein a classical MVC control structure is extended by a supplementary second stage structure (120), each comprising an MVC-controller ($W_1(z)$, $W_2(z)$), are interconnected and combined such that if the equality $\hat{S}(z)=S(z)$ holds, then their associated system transfer function (H(z)), which in this embodiment is the analytic relationship derived from the system's components between the residual error signal (e(n)) in Z-Transform domain (E(z))and the disturbance noise signal (d(n)) in Z-Transform domain (D(z)), corresponds to:

$$\frac{E(z)}{D(z)} = \frac{1}{(1 + S(z)W_1(z))(1 + S(z)W_2(z))}.$$

15. The active noise cancellation system (100) according to claim 14, wherein the multi-stage control system comprises n additional MVC feedback control structures, each comprising an MVC-controller ($W_n(z)$), wherein the MVC control structures are interconnected and combined with each other such that if the equality $\hat{S}(z)=S(z)$ holds, then each additional MVC control structure extends the system transfer function (H(z)) by the multiplicative term:

$$\frac{1}{(1 + S(z)W_n(z))}.$$

* * * * *